US010617218B2

(12) United States Patent
Salin

(10) Patent No.: US 10,617,218 B2
(45) **Date of Patent: *Apr. 14, 2020**

(54) METHOD FOR ADJUSTING MATTRESSES INTO AN OPERATING POSITION AND MECHANISM FOR PERFORMING SAID METHOD

(71) Applicant: Roberto Salin, Bolzano (IT)

(72) Inventor: Roberto Salin, Bolzano (IT)

( * ) Notice: Subject to any disclaimer, the term of this patent is extended or adjusted under 35 U.S.C. 154(b) by 356 days.

This patent is subject to a terminal disclaimer.

(21) Appl. No.: 15/511,048

(22) PCT Filed: Sep. 15, 2015

(86) PCT No.: PCT/EP2015/071017
§ 371 (c)(1),
(2) Date: Mar. 14, 2017

(87) PCT Pub. No.: WO2016/041923
PCT Pub. Date: Mar. 24, 2016

(65) Prior Publication Data

US 2017/0273466 A1 Sep. 28, 2017

(30) Foreign Application Priority Data

Sep. 17, 2014 (IT) ..... BZ2014A0036

(51) Int. Cl.
*A47C 17/86* (2006.01)
*A47C 17/26* (2006.01)
(Continued)

(52) U.S. Cl.
CPC ..... *A47C 17/86* (2013.01); *A47C 17/26* (2013.01); *A47C 17/28* (2013.01); *A47C 17/30* (2013.01); *A47C 19/02* (2013.01)

(58) Field of Classification Search
CPC ..... A47C 19/02; A47C 19/04; A47C 19/045; A47C 17/26; A47C 17/84; A47C 17/86; A47C 17/28; A47C 17/30; A47C 31/00
See application file for complete search history.

(56) References Cited

U.S. PATENT DOCUMENTS 1,001,390 A * 8/1911 Gross ..... A47C 19/045 5/24
1,945,875 A * 2/1934 Woller ..... A47C 17/84 292/281

(Continued)

FOREIGN PATENT DOCUMENTS

| | | |
|---|---|---|
| DE | 846 157 C | 8/1952 |
| EP | 0 781 517 A1 | 7/1997 |
| GB | 2 276 315 A | 9/1994 |

OTHER PUBLICATIONS

International Search Report, dated Nov. 17, 2015 (2 pages).

*Primary Examiner* — Nicholas F Polito
*Assistant Examiner* — Rahib T Zaman
(74) *Attorney, Agent, or Firm* — Jacobson Holman, PLLC.

(57) ABSTRACT

A method and to a mechanism for adjusting mattresses or chair beds into an operating position comprising extendable guides in which rods run, which merge in a joint pin, which interacts with pins of a mattress, which protrude from a centreline of the mattress. A parallelogram has joints, which are connected to each other through an elongated-hole guide, one joint can be moved in the elongated-hole guide, wherein the rods are articulated to the joint pin, a bushing arranged therebetween, the pin extends into a pulley having a restoring spring, on which pulley a cable is wound and fastened to the joint, at a certain height of the mattress, the cable is (Continued)

tensioned and the angle is reduced, the cable causes the rotation of the pulley in such a way that the mattress is rotated.

25 Claims, 39 Drawing Sheets

(51) Int. Cl.
*A47C 17/28* (2006.01)
*A47C 17/30* (2006.01)
*A47C 19/02* (2006.01)

(56) References Cited

U.S. PATENT DOCUMENTS 2,112,355 A * 3/1938 Archer ..... A47C 17/84 5/10.2
2,575,189 A * 11/1951 Schmidt ..... A47D 9/005 280/43
3,829,912 A * 8/1974 Quakenbrush ..... A47C 17/84 5/10.2
4,494,259 A * 1/1985 Miller ..... A47C 19/045 5/616
4,856,129 A * 8/1989 Butler ..... A47C 19/045 5/610
5,984,404 A * 11/1999 Novoa ..... A47C 17/84 296/190.01
6,711,765 B1 * 3/2004 Mitchell, III ..... A47C 19/04 403/203
6,851,376 B2 * 2/2005 D'Agostino ..... A47B 51/00 108/147
7,377,362 B2 * 5/2008 Blodgett, Jr. ..... B60P 3/39 187/222
7,802,840 B1 * 9/2010 Shea ..... B62D 33/0612 296/190.02
2003/0041377 A1 * 3/2003 Bailey ..... A47C 17/84 5/118
2009/0255056 A1 * 10/2009 Burnett ..... A47C 17/86 5/11
2010/0223722 A1 * 9/2010 Burnett ..... A47C 17/86 5/11
2011/0265269 A1 11/2011 Scarleski

* cited by examiner

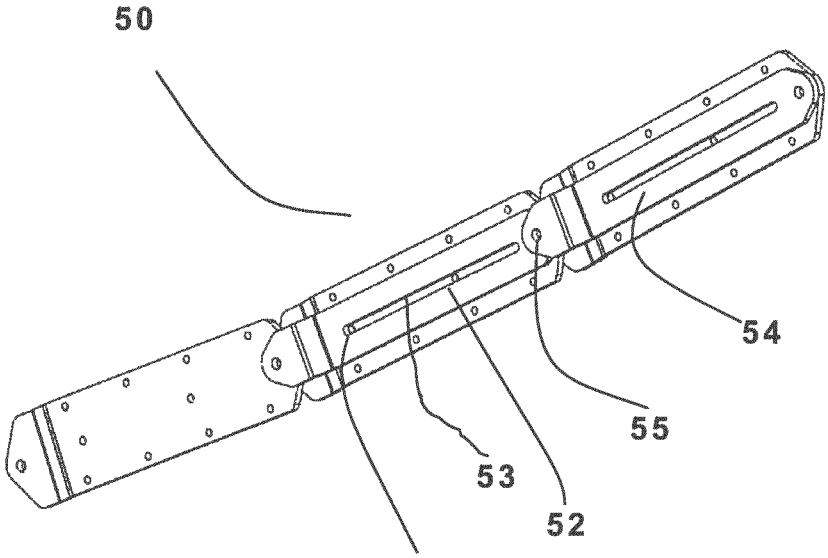
Fig. 27
Fig. 28
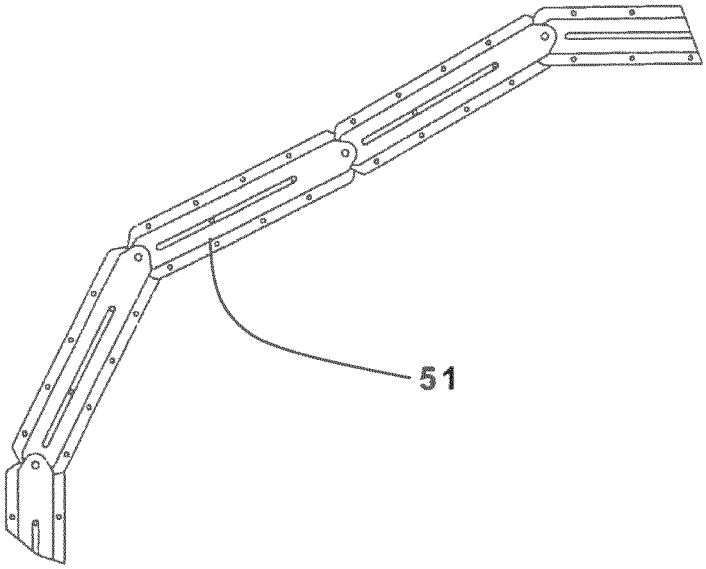

METHOD FOR ADJUSTING MATTRESSES INTO AN OPERATING POSITION AND MECHANISM FOR PERFORMING SAID METHOD

The present invention relates to a method for moving mattresses into an operating position according to the classifying part of claim 1 and to a mechanism for its actuation according to the classifying part of claim 6.

For this type of beds there is a need to be able to vary the surface turned towards the sleeper. This may be in order to change the transpiration position and also to vary the load to which the mattress is subject also for changing the conformation of a mattress.

Patent application US 2011/0265269 describes a device for facilitating the rotation of a mattress in a horizontal plane on springs or a platform about a vertical axis. This device is equipped with elements adapted to allow the rotation of the mattress about a vertical axis hence being able to vary the head part of the mattress with the foot part and vice versa.

However, this publication does not solve the problem of being able to conveniently change the top side of a mattress with the bottom one and vice versa. This possibility is useful both for ventilating the mattress and also for changing the load to which the side itself is subject. This movement of turning the mattress has up to now been performed by the user or, for example, in hospitals, by personnel.

Publication DE 846 157 describes a rotation device for couches with double-sided support of the reclining frame which provides a pantograph that is located below a load of traction springs for the purpose of compensating for the weight and is supported with its lower articulation on the lower support structure of the couch, while the upper articulation is conformed like a support pin for the rotatable reclining frame.

As can be noted the frame must be raised with force to be able to turn it into a position of the upper articulation at a sufficient height to be able to turn the frame through 180°. The pantograph itself is not equipped with any activator for its movement and cannot be blocked in the position in which the frame itself is to be turned. Furthermore, this rotation device is not intended for bed mattresses that are to be ventilated and are to be brought into a comfortable position for remaking.

Publication GB 2 276 315 discloses a vertically movable bed assembled on a pair of rails which are arranged on a wall through rollers that are engaged in the rails. The movement of the bed takes place manually or through a hydraulic drive. No part of this document describes the property of being able to turn the bed about its axis by 180° for remaking. The application of the rails to the wall of a room is also complicated.

Publication U.S. Pat. No. 2,112,355 describes an elevator for beds with rotating means arranged in and below the centre of gravity of the bed, with pulleys fixed above the bed and with cable means which extend around the said pulleys and engage the rotating means to transport the bed upwards hence causing the bed to overturn during the ascent.

This document does not include a mechanism for bringing a mattress into an operating position either for remaking the mattress or for making the mattress itself comfortable for a massage or leaving it in a folded position.

Finally, CH 172027 describes a couch with a mattress rotatably supported by the support structure, wherein for the support and guide of the mattress for its overturning on two opposite sides of the couch two rails are provided respectively, articulated by means of an arm rotatable to the support structure. The rails are articulated with an end at a common pin of the mattress and their other ends are arranged slidably in horizontal rectilinear guides fixed to the support structure. The mattress is equipped on both sides, associated with the guide rails, respectively, with two guide pins, of which one is guided along a guide profile fixed to the support structure.

In this case a simple parallelogram-shaped mechanism with two arms converging in the point of rotation of the mattress have arm extensions converging towards the opposite side to the articulation of the mattress in which they slide in horizontal guides. The mattress is brought into the position adapted for its rotation by hand and no stable horizontal position is provided for remaking the bed.

The aim of the present invention is to facilitate the intervention of the user or personnel as much as possible in making the bed or the mattress by changing the position of the mattress, providing a bed or mattress with the possibility to place it in a position such as to facilitate the rotation of the mattress through 180° for changing the two faces of the mattress itself for obtaining a bed with various functions as well as sleeping and massages.

A further object of the present invention is to ensure that the person needing massages (medical examinations) has the economic possibility to receive at their own premises the personnel specialising in massages or medical examinations without having to go out of the house especially for a massage, with the same bed in which they normally (or other people occasionally) sleep, through a mechanism that facilitates the rotation of the bed plane, also transforming it into a bed for massages.

This aim is reached by a method for moving mattresses into an operating position according to the characterising part of claim 1 and a mechanism for its actuation according to the characterising part of claim 6.

Therefore a method is proposed for moving mattresses or armchairs into an operating position that comprises the following steps: equipping a bed with a frame and base or board and with a mattress, provided with gripping pins projecting from the mattress along its halfway plane, with a movement mechanism, raising movement means up to the gripping pins supporting the mattress, coupling the pin of the mattress with an articulation pin of the movement mechanism, up to a height adapted to allow the rotation of the mattress about its halfway plane, turning the mattress about its pins to bring it into an overturned position, lowering the mattress to a position supported by feet, raising the frame and the base and board with the interception thereof by thrust means of the movement mechanism, keeping the frame or base or board in position by means of frame-supporting feet, arranging the mattress, intercepting the frame or base, lowering the frame or base with the mattress with the interception means into the position of use. In one embodiment, the method also comprises the step of activating a tilting system in one direction or the other.

For remaking the bed or arranging the mattress it is also possible to prevent loads or damage (trauma) to the spine by bringing the bed plane to a suitable height for its remaking. This is possible with a mechanism on the floor or on a sub-frame of the bed plane/base, not shown. It is also possible to use anchoring to the feet of the bed. There is also a support (system), not shown, with LEO lamps inserted with UV rays which with a suitable capacity cause damage to the reproductive apparatus of dust mites, preventing their growth and reproduction, thus also providing the possibility of healthier and better sleep. The system for simplification purposes known as “anti-dust mite” is placed between two staffs in proximity to the ends of the trestle-shaped staffs or of other known shapes, with a low voltage power supply built-in and also with a 220 Volt or other voltage connection for countries with different standards. When the UV rays are operating they are not visible to the naked eye, therefore the anti-dust mite system is equipped with a green reference light if it is operating, which is red when it is off. It is also possible to equip it with a timer. As well as being placed in a trestle arrangement on the staffs of the guides or extendible cylinders or actuators, the anti-dust mite system may be fixed in another place, for example below the base/board/slat appropriately equipped with holes or slits or may be arranged on a specifically provided container, which is arranged on the movement mechanism.

In another embodiment, the bed with a sleeping and massage function may obtain said functions through a mechanism arranged on the ceiling from which at least one rope descends at whose lower end there is a pulley connected to the pin extracted from the internal frame of the mattress and having at least one cable fixed on one of its sides while it remains free on the other side. The ropes at the top ends i.e. on the ceiling are wound onto two reels/drums that, appropriately activated in a known way, ensure that they are wound and unwound around a pulley, causing the rotation of the bed plane through 180° overturning it.

In another embodiment, the cables that descend from the ceiling through the reel/drum at whose lower end at least one rotation mechanism is connected, after reaching the pin of the internal mattress frame and once the same has been activated after the drum(s) placed at the top end of the ceiling are wound and unwound, raising and lowering the mattress, the mechanism placed on the lower side with known activation of the ropes/cables, makes the mattress turn through 180°. Once the mattress has been overturned the sleeping side is on the bottom and the massage bed, not shown here, is on the top part.

The internal mattress frame has at its centre in the longitudinal or transversal direction according to which direction the mattress is to be turned in—head feet—or otherwise a pin with connecting rods or ring nuts which when extracted activates the connecting rods or ring nuts also with connecting rods connected to the removable part of the frame making it stiff. When the pin is not extracted the connecting rods on the ring nut or on the pin are in the resting condition and the stiffening mechanism of the frame itself is not applied, therefore the frame placed inside the mattress takes the form of a possible motorised base in its functions. By activating the extraction of one pin, the opposite pin is also extracted because in one case there are between the two internal sides of the frame two sliding levers that are inclined with respect to the axis of the pin in the parallel inclined form connected to the two central ends through a third central lever activating the exit of one pin, therefore the opposite one exits, just as when one re-enters the other one re-enters since the levers are connected at their external ends to the pins that exit. In another embodiment instead of the levers, a sheath can be used, with a cable inside it according to the Bowden method, hence allowing one pin and the opposite one to exit and re-enter simultaneously. On one side the sheath is fixed to one of the extractable pins and is locked on the other side, externally supporting the other pin. The cable is connected to the latter extractable pin, while on the other side its end is locked to the external support of the other pin. The internal mattress frame pins may be equipped with springs adapted to facilitate the exit of the pins from the frame.

Through the lifting and rotation mechanism the mattress, through its internal frame and its pins, is raised up to the 180° rotation point, overturning before being lowered to the sleeping plane. The rotation takes place through the articulated parallelogram to which a wire or cable is applied with a guide slot fixed to the ends with a pulley in which a spring is inserted and the cable is wound and fixed in a point of the pulley so that by turning the pulley it cannot perform a rotation greater than 180°; for this purpose there is at least one stop (not shown). The rotation can begin as soon as the shorter length from the centre of the mattress exceeds the length of the mattress itself from its centre by a few centimetres. It is preferable once the mattress has reached an ideal height to start turning by pressing against the articulated parallelogram connected to the guide staffs, telescopic cylinders or actuators hence the wire/cable that is connected to the pulley and to the lower part of the articulated parallelogram with the guide slot that may also be connected in another place, the pulley itself and the mattress are turned through 180° about their pin outside the mattress frame and connected through the joint with the pulley. The lifting mechanism combined with the joint through the staffs that converge onto it is raised until the coupling height to the frame pin. To satisfy the task of the anti-shock function by the frame/base/board profile, plates are extracted from the pockets, which are parallel to one another, while the another two plates that are parallel to one another remain in the resting condition and vice versa. By raising the lifting mechanism and joining the rails/cylinders/rollers on the arms resting on the staffs converging onto the plates, the positions described above are obtained. The feet are in telescopic form with locking and unlocking of a known form. At their ends there is a joint that converges into a slide according to the functions placed on the four parallel sides the frame/base/board profile which allows the base to be tilted according to requirements since when it is tilted the axis is slightly shorter than in the resting position. The arms with the rails, cylinders/rollers may, in another embodiment, be arranged not on the plates placed at the upper end of the frame/base/board profile, but actually at the lower end or on its outer side joining with the plates or with other rests. In another embodiment represented herein, said functions may be performed. The arms with rails/cylinders/rollers are replaced by elements forming the articulated parallelogram, at whose upper ends there are the rails/rollers/cylinders which, as mentioned above, can intersect both those in the upper part of the frame profile and the plates extracted from the pockets or also in the lower part of the frame, base or board profile. To bring the mattress plane into the remaking or operating position of the bed through the telescopic cylinders, extensible guides or actuators may also be activated or levers with activation of the known type and the arms must be extracted from the pockets in another embodiment not shown here, with the rails/cylinders/rollers which are joined to the lower part of the frame or to the plates placed on the upper side of the frame.

The lifting mechanism as a whole either on the ceiling or the floor may be placed either on the longitudinal or the transversal side of the mattress/bed as may the pin/rest of the mattress frame.

Further details and features are shown in the claims and the following description of preferred embodiments and variants, depicted in the attached drawing, included by way of non-limiting examples, wherein FIG. 1 shows a schematic front view of a movement mechanism in the resting position in a first variant, FIG. 2 shows a schematic front view like FIG. 1 in a second variant, FIG. 3 shows a schematic front view like FIG. 1 in a tilted position, FIG. 4 shows a schematic front view of a movement mechanism in a raised operating position, FIG. 5 shows a schematic front view of a movement device in the raised position of the vertically arranged mattress, FIG. 6 shows a view like FIG. 5 in a variant, FIG. 7 shows a view like FIG. 1 with a mattress for massages in a position ready for massages and in a variant of the activator shown in FIG. 6, FIG. 8 shows a view like FIG. 7 with the activator and parallelogram in a variant, FIG. 9 shows a view like FIG. 1 with a mattress for massages in the sleeping position, FIG. 10 shows a view like FIG. 9 with the activator in a variant, FIG. 11 shows a view like FIG. 10 in the raised operating position for remaking the bed, FIG. 12 shows a view like FIG. 11 with the mattress in the position for massages, FIG. 13 shows a view like FIG. 12 with elements of the massage plane angled to one another, FIG. 14 shows a view like FIG. 5 but with a mattress for massages, FIG. 15 shows a view like FIG. 14 but with the activator in a variant, FIG. 16 shows a partial schematic front view of the movement mechanism at its support top of a mattress for its automatic 180° rotation, FIG. 17 shows an axial section of a mattress support pin, FIG. 18 shows a detail of the mattress support pin, FIG. 19 shows a front view of a coupling guide between the mattress pin and the support pin, FIG. 20 shows a lateral view of FIG. 19, FIG. 21 shows a rear view of FIG. 19, FIG. 22 shows a housing pocket for interception bars, FIGS. 23, 24, 25 and 26 schematically show a chain/frame conformation inside a mattress, FIG. 27 shows chain links engaged by jointed and movable plaques, FIG. 28 shows links like FIG. 27 in the bending position of the chain, FIG. 29 shows a perspective view of a frame inside the mattress showing the activator of the jointed and sliding plaques, FIG. 30 shows a view like FIG. 29 in a variant of the activator of the form of a Bowden cable, FIG. 31 shows a view like FIG. 29 with an activator of the plaques in a view from above in a further variant, FIG. 32 shows a lateral view of FIG. 31, FIG. 33 shows a view with an activator of the plaques in a further variant of FIG. 31, FIG. 34 shows a view from above of FIG. 30, FIG. 35 shows a view with an activator of the plaques in a further variant from above, FIG. 36 shows a lateral view of FIG. 35, FIG. 37 shows a schematic perspective view of a movement mechanism hanging from the ceiling of a room, with the mattress raised FIG. 38 shows a schematic front view of a detail of FIG. 37, FIG. 39 shows a schematic perspective view like FIG. 37 in a variant, FIG. 40 shows a schematic perspective view of a motorised pin for the lifting, coupling and rotation of a mattress, FIG. 41 shows a schematic front view of a movement mechanism in the form of a pantograph in a second variant, in the operating position, FIG. 42 shows a view like FIG. 41, but in a tilted position of the mattress, FIG. 43 shows a view like FIG. 41, but in a raised position of the movement mechanism and in the bed remaking position, ready for the operator and FIG. 44 shows a view like FIG. 41, but in a raised position and rotated through 90° of the frame or base or mattress, FIG. 45 shows a view of a movement device in the raised or lowered position of the vertically arranged mattress, where ultraviolet rays are irradiated by at least one neon lamp 101, FIG. 46 shows a view of a movement device in the raised or lowered position of the vertically arranged mattress, where ultraviolet rays are irradiated by at least one LED lamp 102, FIG. 47 shows a view like FIG. 44 where at least one neon lamp 101 is in the support.

FIG. 48 shows a view like FIG. 44 where at least one LED lamp 102 is in the support.

In FIG. 1, reference number 1 represents a bed according to the invention. The bed in a known way has a frame 2, with a base that is not shown, supported by telescopic feet 3 that can be positioned in a known way at various heights with respect to a floor 4. At the front sides of the bed 1 a movement mechanism 5 is externally arranged. This comprises guides 6 and 7 in which staffs 8 and 9 are slidable, respectively, converging into an articulation pin 10. At their free ends the staffs 8 and 9 are equipped with articulations 11 and 12 to the floor 4.

On the frame 2 a mattress 13 is arranged, in whose halfway plane, preferably longitudinal, pins 14 project, when they are extracted.

Arms 16 and 17 are fixed at the exit thereof from the guides 6 and 7 to the staffs 8 and 9, in their retracted position, in the guides 6 and 7, respectively carrying rollers/rails/cylinders 18 adapted to come into contact with the plates 119 exiting from pockets 19 provided on the top side of the frame 2. Staffs 23 and 24 are articulated at equal distances of the articulation pin to the staffs 8 and 9 hence forming a parallelogram with the staffs 8 and 9.

In FIG. 2 in one variant the staffs 23 and 24 extend beyond their joints 25 and 26 carrying at their ends a roller/rail/cylinder 28 substituting the arms 16 and 17.

FIG. 3 shows a foot 3 with a telescopic section 29 for partially raising the mattress/bed.

FIG. 4 shows the situation in which from the foot 3 a further telescopic section 30 has been extracted with interception plates extracted from the pockets 19. Thus, the frame is resting on said plates 119 in a stable position for being able to remake the bed, but supported by the feet 3.

In FIG. 5, the staffs 8 and 9 are extracted from their guides 6 and 7 in which the articulation pin 10 is coupled with the rotation pin 14 of the mattress 13. This position is reached with the plates 119 retracted into the pockets 19. The mattress 13 is located in a vertical position reached as more clearly specified below.

In FIG. 6 the extraction of the telescopic cylinder staffs/actuators and therefore the raising of the articulation pin is achieved by levers 31 and 32 articulated to the base 33 and engaged through a slot 131 with a pintle 132 projecting from the staffs 8 and 9, respectively.

FIG. 7 shows a mattress 34 with a board 35 for massages facing upwards and with the sleeping side 36 downwards. The internal mattress frame 182 is also outlined. FIG. 8 shows a movement mechanism 5 with the mattress for massages 34 and activation staffs 23 and 24 that push the plates 119 through their rollers/rails/cylinders 28.

FIG. 9 instead shows a mattress for massages 34 with the mattress plane 35 facing downwards and arms 16, 17 that push the plates 119.

FIG. 10 shows a further method of activation of the staffs 8 and 9 through the levers 31 and 32.

FIG. 11 shows the movement mechanism 5 in the raised position with the mattress for massages 34 with the board for massages 35 facing downwards.

FIG. 12 corresponds to FIG. 11, but with the massage plane 35 facing upwards.

FIG. 13 shows an example with the massage plane comprised of a head element 38, a lumbar element 39 and a lower element 40 connected to one another and activatable by mechanisms with lifting movement shown here or actuators not shown 138 and 140. Inside the mattress on which the massage board is resting, as well as housing hinges for tilting the massage plane, supports are provided, resting on the base, frame or board.

FIG. 14 shows a bed in the vertical position of the massage mattress 34.

FIG. 15 shows a variant with levers 31 and 32 for activating the movement mechanism. FIG. 16 shows the parallelogram whose articulations 22 and 10 are connected to one another by a guide slot 41 with an articulation 22 sliding in the guide slot 41. As shown more clearly in FIGS. 17, 18, 19, 20 and 21, the staffs 8 and 9 are articulated to the articulation pin 10 with the interposition of a bushing 44. The pin 10 extends on one side into a pulley 43 onto which a wire 42 is wound, fixed at its free end with the articulation 22. The wire 42 at a certain height of the mattress, i.e. at a certain angle between the two staffs 8 and 9 is taut and by further reducing the angle the wire makes the pulley 43 rotate so as to turn the mattress itself.

The pin 10 appropriately extends into a disc 46 with a key 47 adapted to be coupled with the hollow of a disc 48 at the end of the pin 14 extractable from a tubular portion 49 fixed to the mattress frame. To guide the coupling between the disc 46 and the disc 48 better, the disc 48 in the advancement of the pin 10 in the direction 110 is appropriately oriented by a guide funnel 45 extending above the guide slot 41. This funnel is shown in FIGS. 19, 20 and 21 by three different views.

FIG. 22 schematically shows a perspective view of a pocket from which the plate 119 exits.

FIGS. 23, 24, 25 and 26 schematically show a lateral view of a chain/frame 50 in various conformations of the chain/frame (comprising the internal mattress frame that offers the possibility to turn the links of the chain/frame about articulations 51). Each link of the chain/frame has pintles 52 of the internal mattress frame that engage in slots 53 of plaques 54 connected to one another through joints 55. The plaques 54 can therefore be moved with respect to the links of the chain/frame and their joints 55 may be brought to coincide with the articulations 51 of the links of the chain/frame. By moving the plaques 54 the articulations 51 and joints 55 no longer coincide and the plaques 54 make the chain/frame 50 stiff. The mobility of the chain/frame is shown in FIG. 28.

FIG. 29 shows a possibility to move the plaques 54 through connecting rods 56 articulated eccentrically to a disc/ring nut 57 and to the plaques 54. Therefore, by turning the disc 57 through a screw 58 that is activated by extracting or reinserting the pin into the frame, the chain/frame may be brought from a stiff position to a mobile position.

In FIG. 30 the movement of the plaques 54 may be obtained by means of a Bowden cable of the known type.

Figure 37:
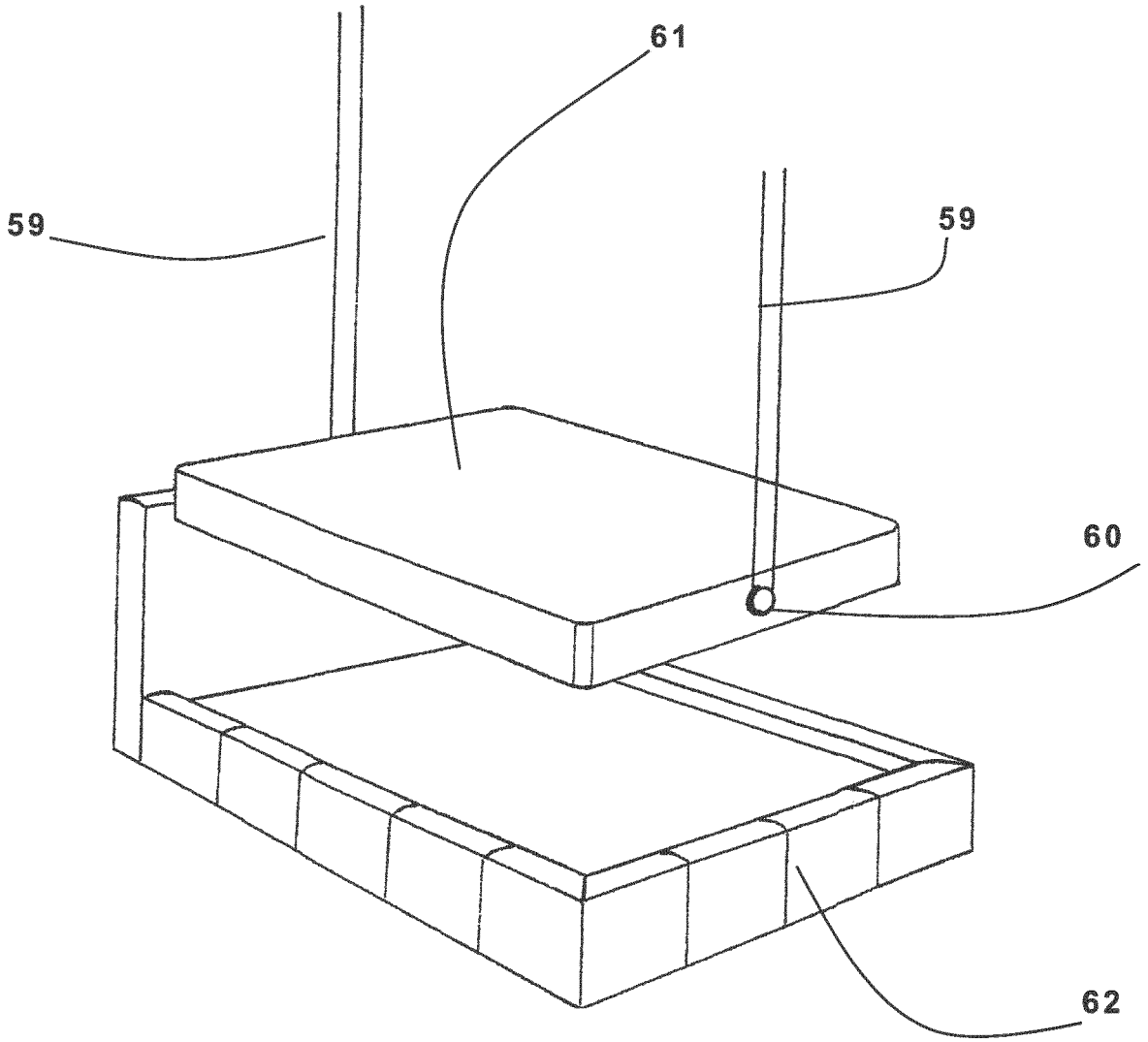
Figure 38:
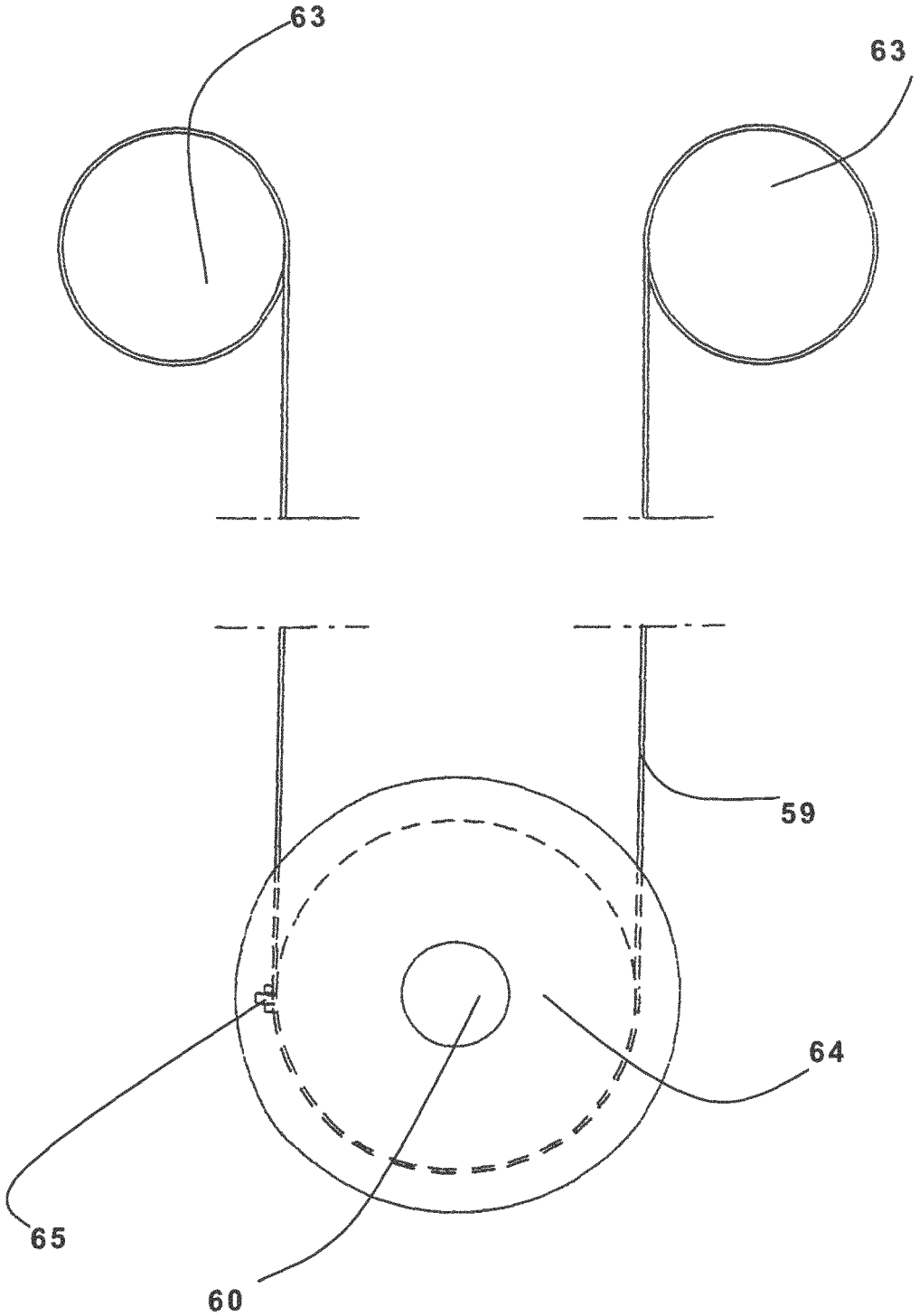

FIG. 37 shows a movement mechanism made with at least one rope 59 hanging from the ceiling of a room for winding around a pin 60 of a mattress 61. The mattress is raised above the case 62 of a bed. In FIG. 38 the rope is unwound from drums 63 to be wound around a pulley fixed to the pin 60 of the mattress 61. For the rotation of the pin 60 the rope 59 is fixed by means of a stop 65 to the pulley 64.

Figure 39:
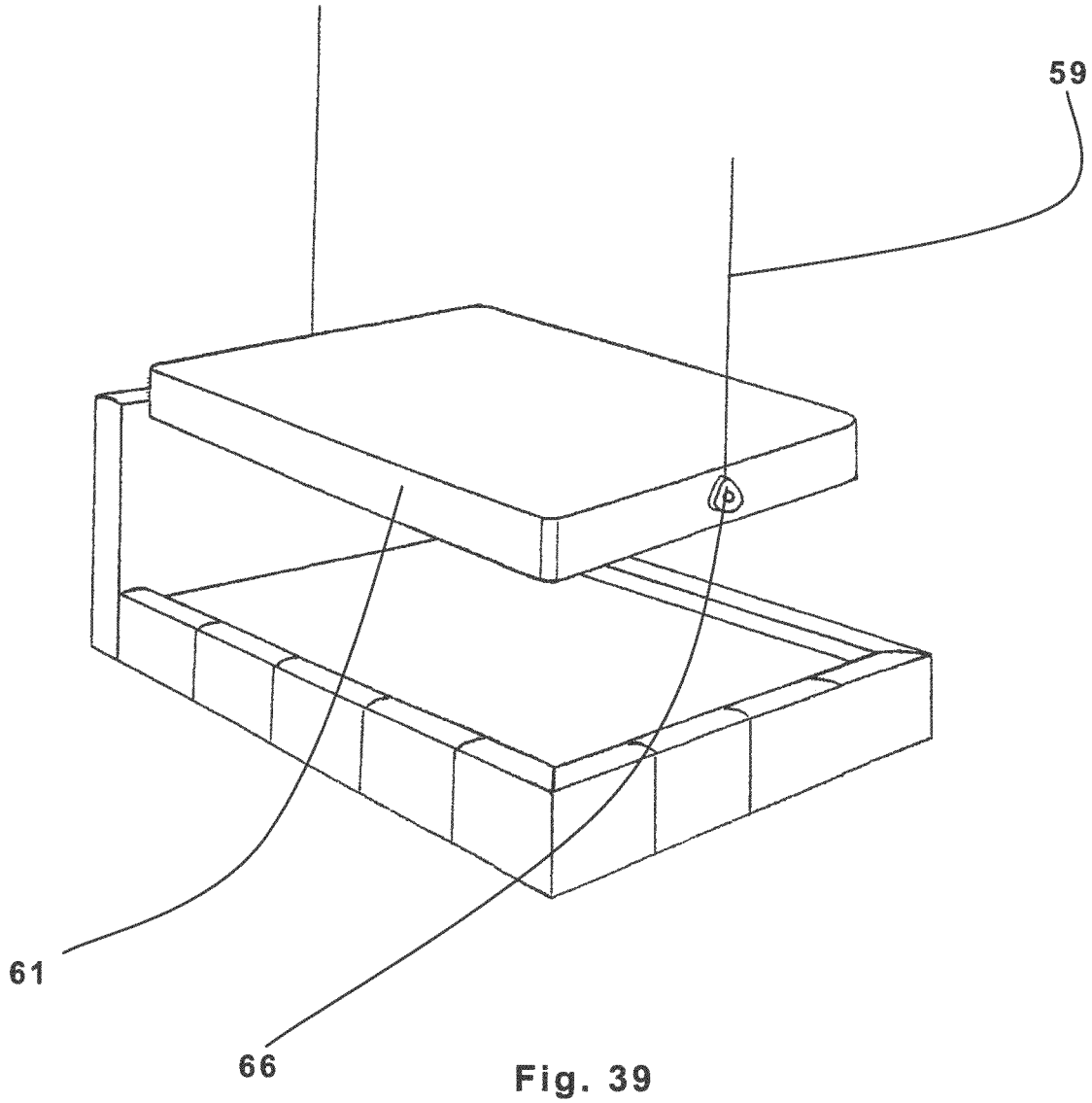
Figure 40:
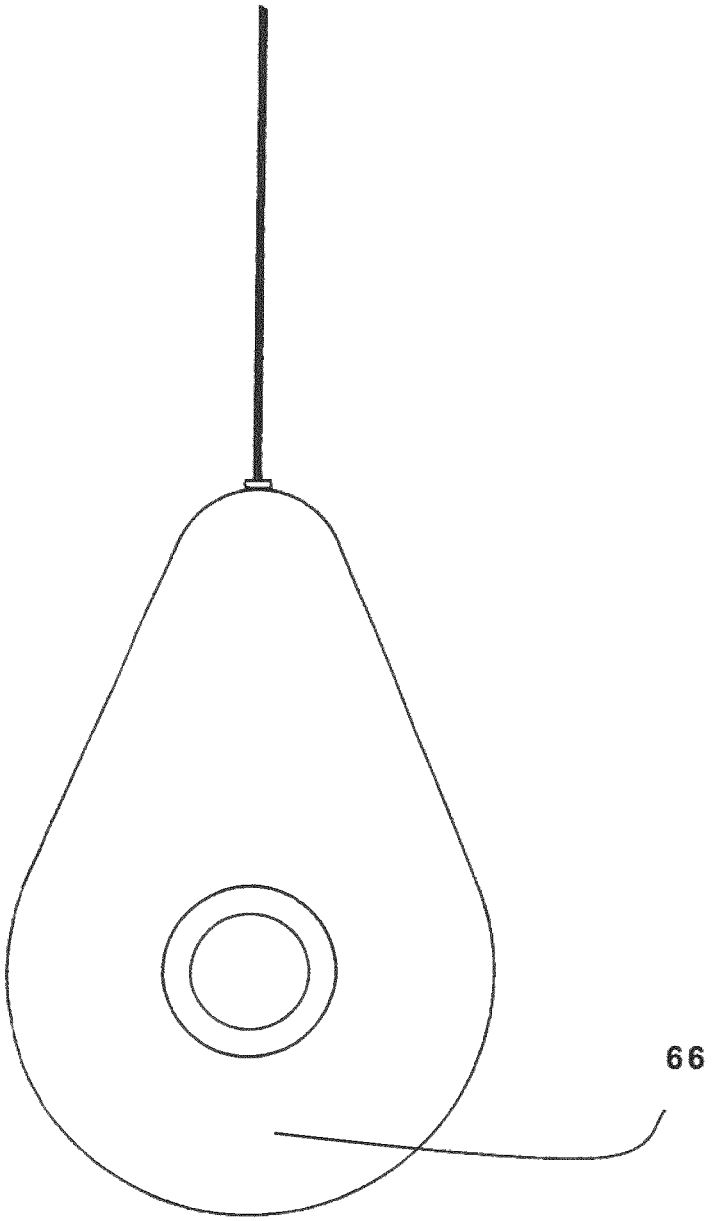

In FIGS. 39 and 40 in one embodiment the mattress 61 is hanging from the pins through a motorised rotation mechanism 66 hanging from the rope 59.

FIGS. 41 to 44 show a further embodiment in which a frame/base/mattress unit is indicated overall by reference number 67. It is equipped in a known way with extensible feet 68 and therefore that can be raised to various positions. The feet 68 are resting on the floor 69 and carry at the top a frame 70 in which or on which a mattress 71 is arranged for example with the interposition of a base, not shown.

The mattress 71 is equipped, as already described with reference to the embodiment shown in FIGS. 1 to 6, with rotation pins 72 respectively projecting from two parallel sides of the mattress 71, with a conformation for example of the type shown in FIG. 17. On a support plate 73 a movement mechanism is arranged in the form of a pantograph 74.

The pantograph 74 is formed by two staffs 75 and 76 articulated to one another in 77 and by two staffs 78 and 79 articulated to one another in 80 to the ends of which, in 81 and 82, the ends of the staffs 75 and 76 are articulated with a parallelogram conformation.

The free end of the staff 75 is articulated in 83 to a slider 84 movably guided on the plate 73. A screw 85 is engaged in the slider 84 for its movement, which screw 85 being activated by a motor 86 for example electrical. The staff 76 instead is articulated in 98 to the plate 73.

The staff 79 is articulated at its free end in 87 and the staff 78 in 88 to a beam 89. Appropriately the joint 88 of the staff 78 is formed by a pin sliding in a slot 90 obtained in the beam 89.

Figure 42:
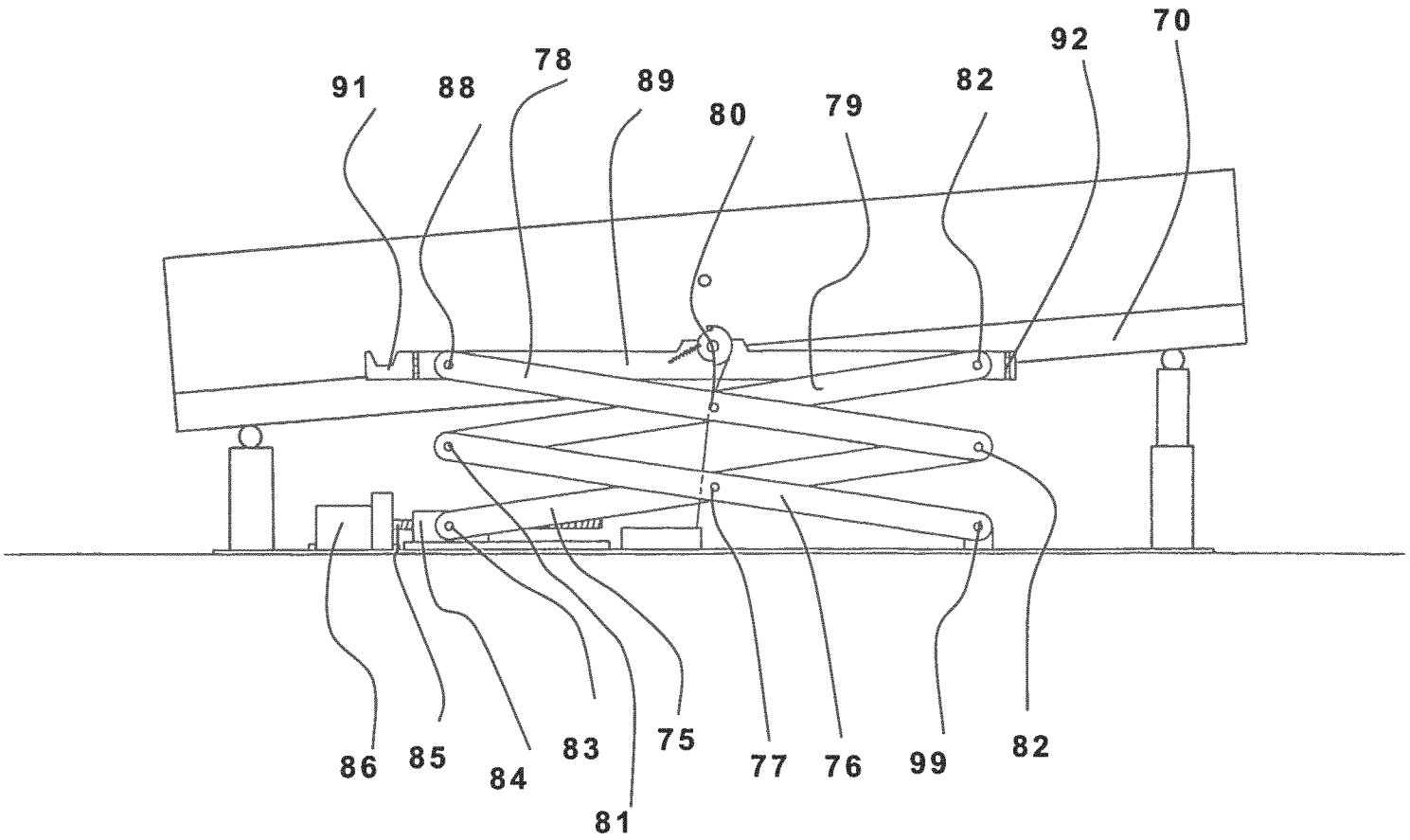
Figure 43:
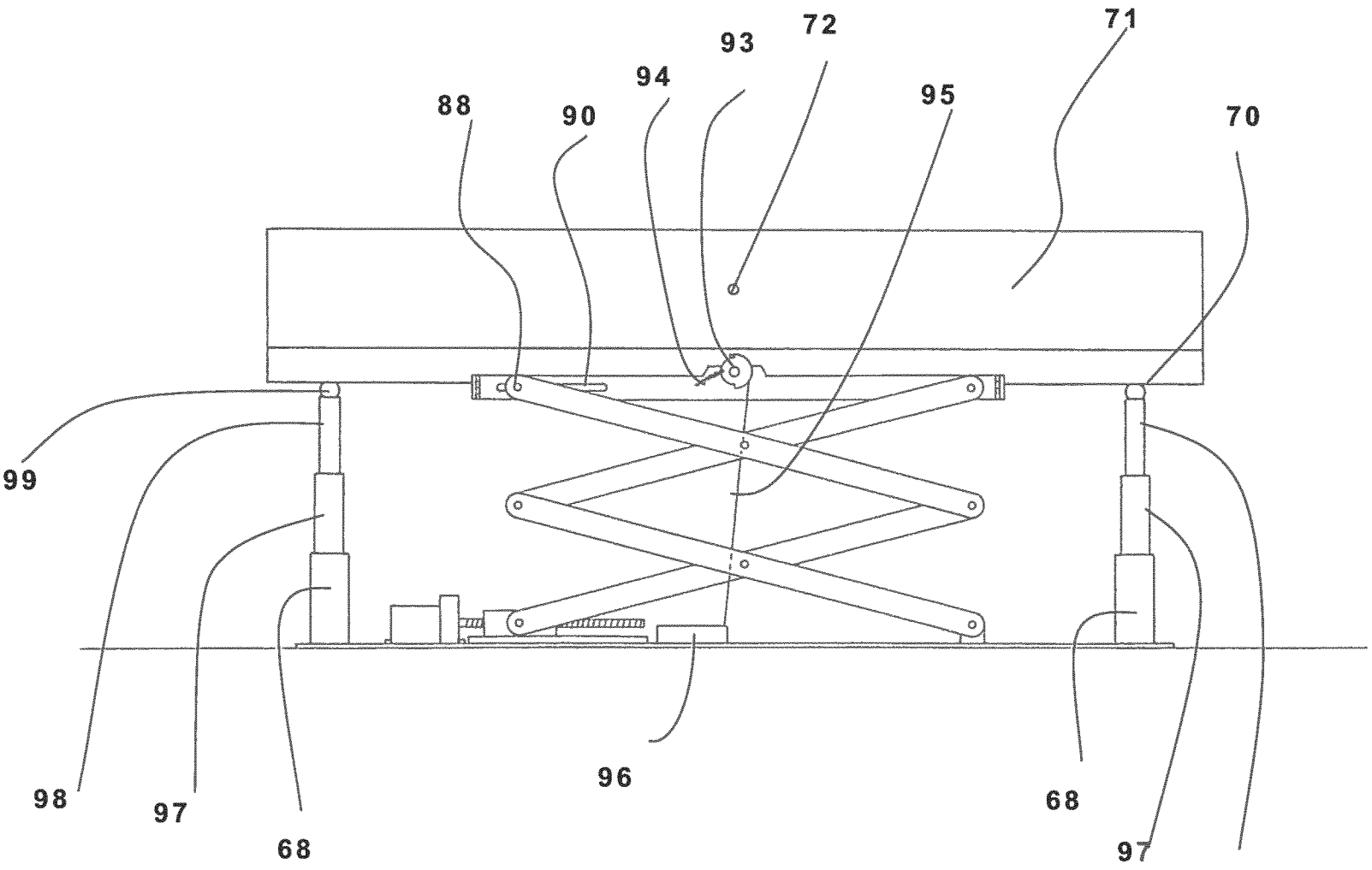
Figure 44:
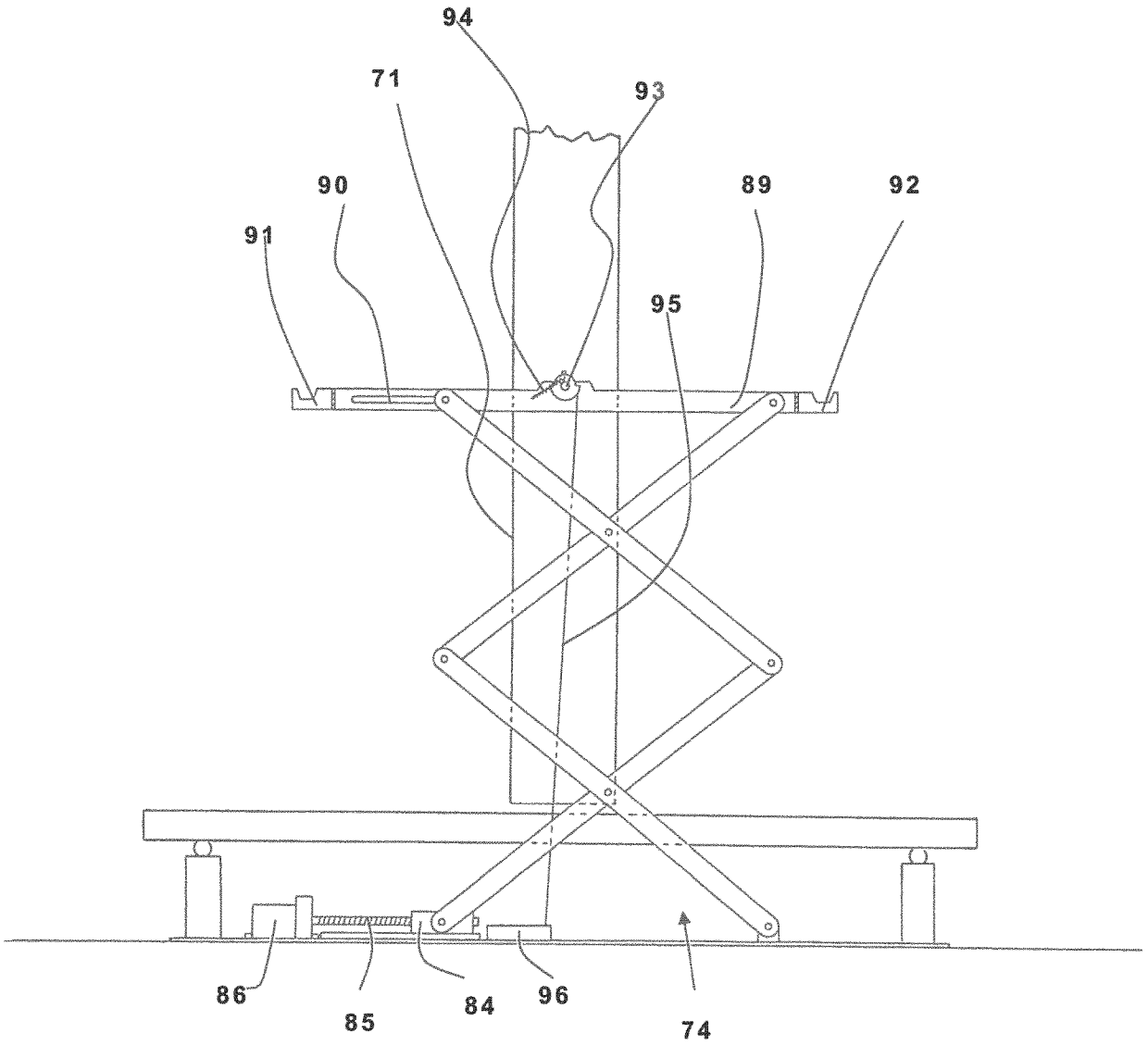
Figure 45:
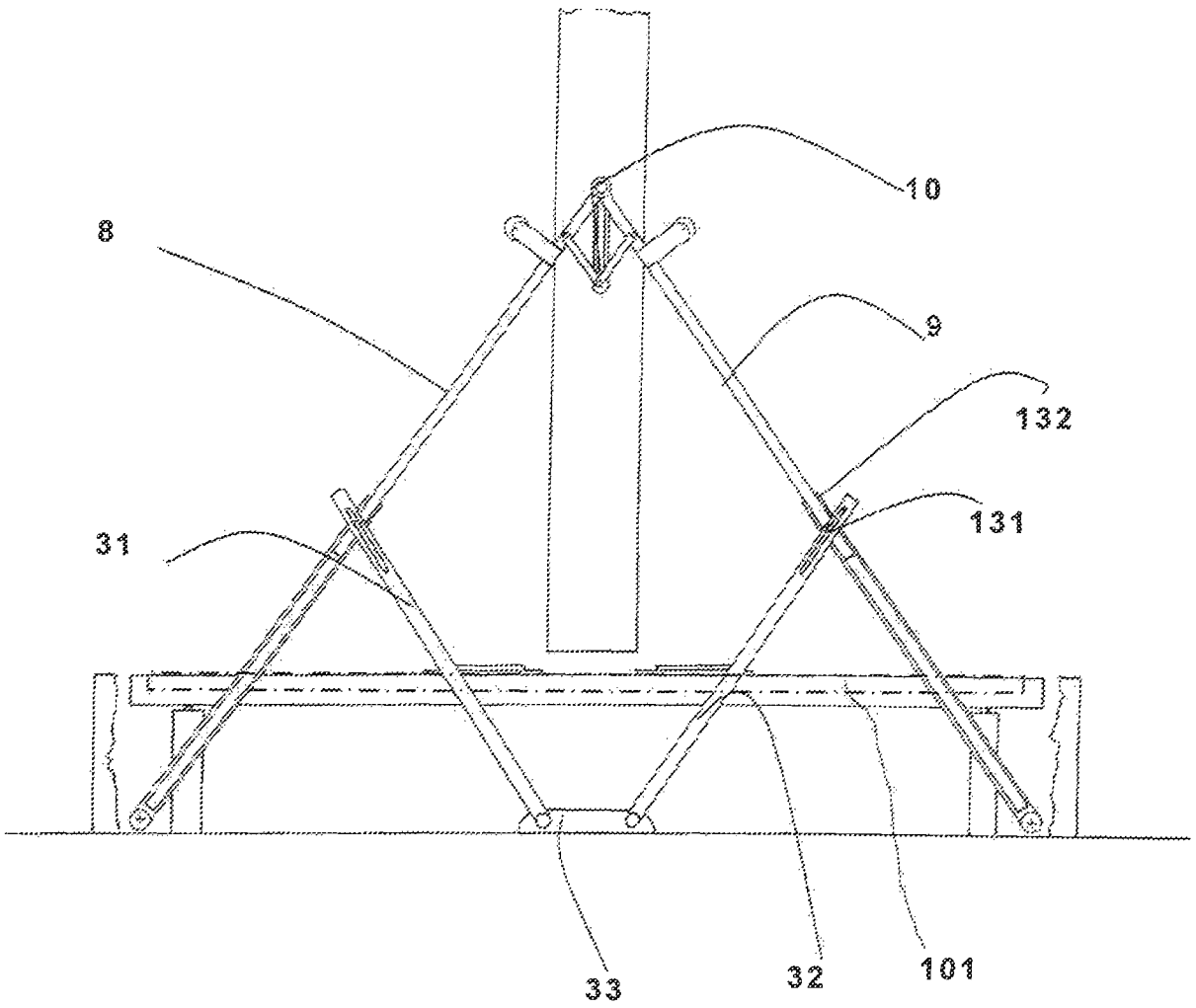
Figure 46:
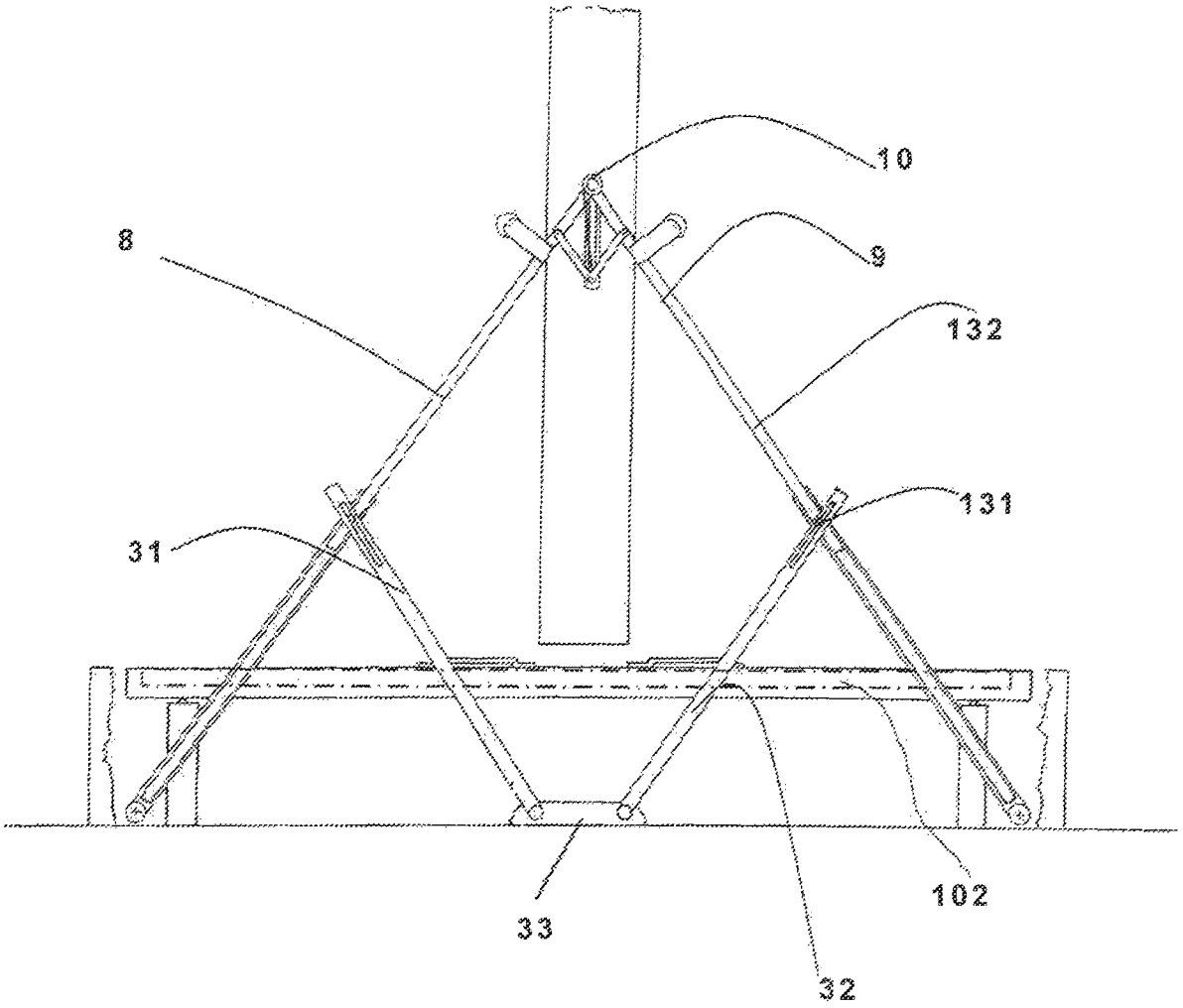
Figure 47:
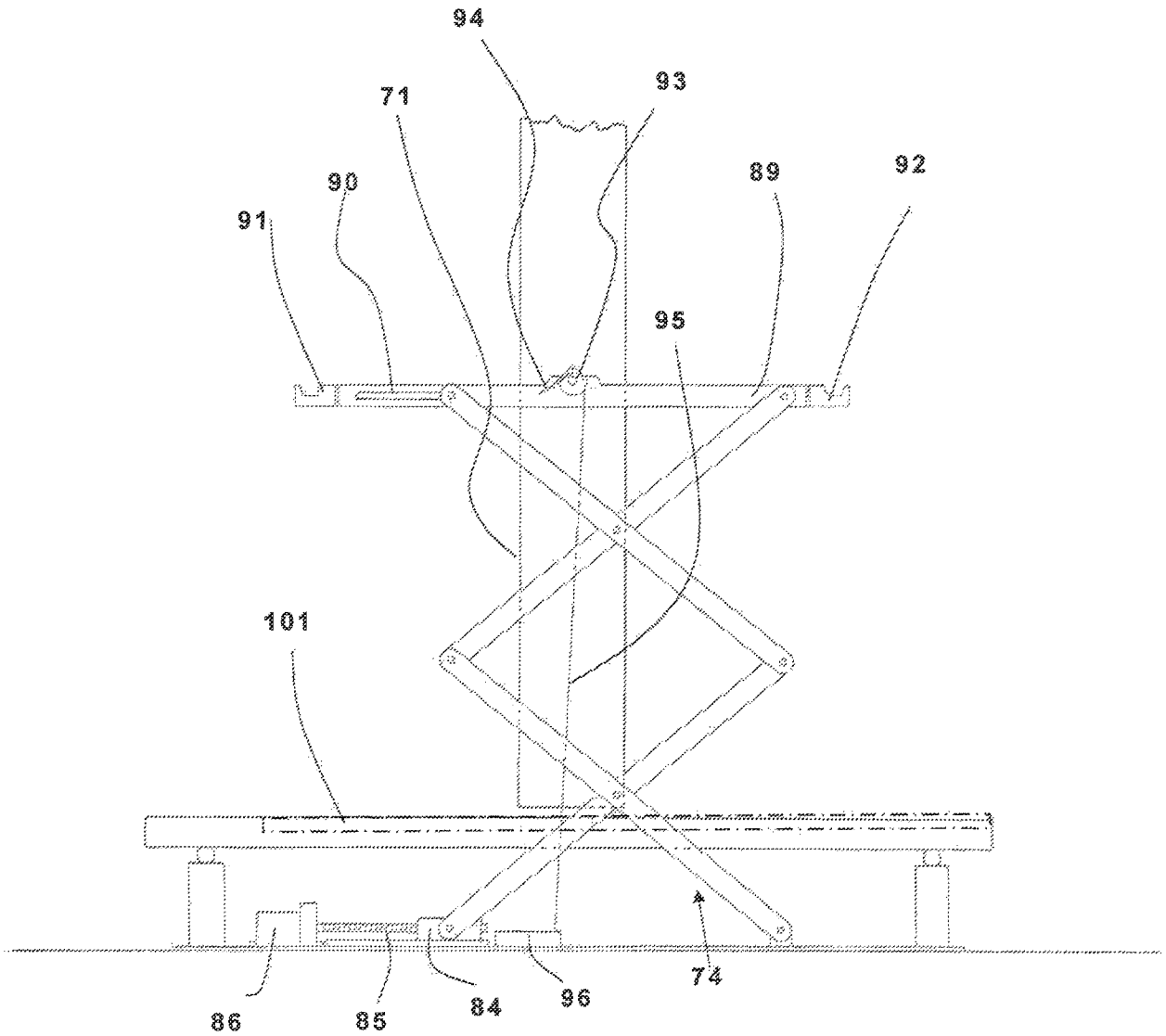
Figure 48:
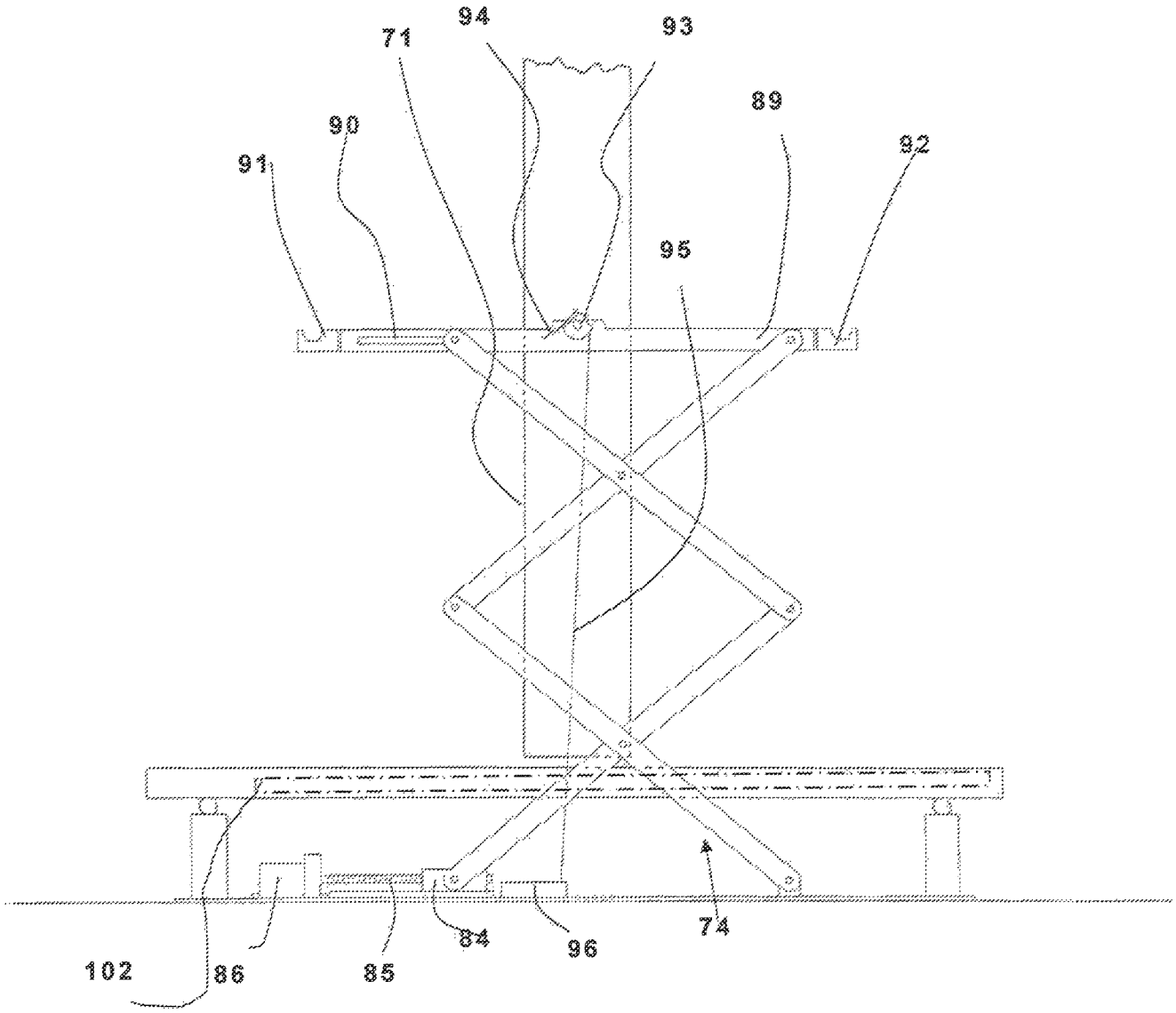

The beam 89 is equipped at its ends with tabs 91 and 92 respectively. The two tabs 91 and 92 are respectively bendable from a position in the extension of the beam 89 into a perpendicular position to the axis of the beam 89 so as to completely, as shown in FIG. 43, or partially, as shown in FIG. 42, intercept the frame 70. This bending movement may be performed for example by means of an electromagnetic system of the known type, not shown. With the interception of the frame 70, it may be brought by the tabs 91 and 92 or only by one of the two into a raised or tilted position, in the case in which only one of the two tabs is bent. The various positions are defined with the extraction of sections 96 and 97 of the feet 68.

Figure 1:
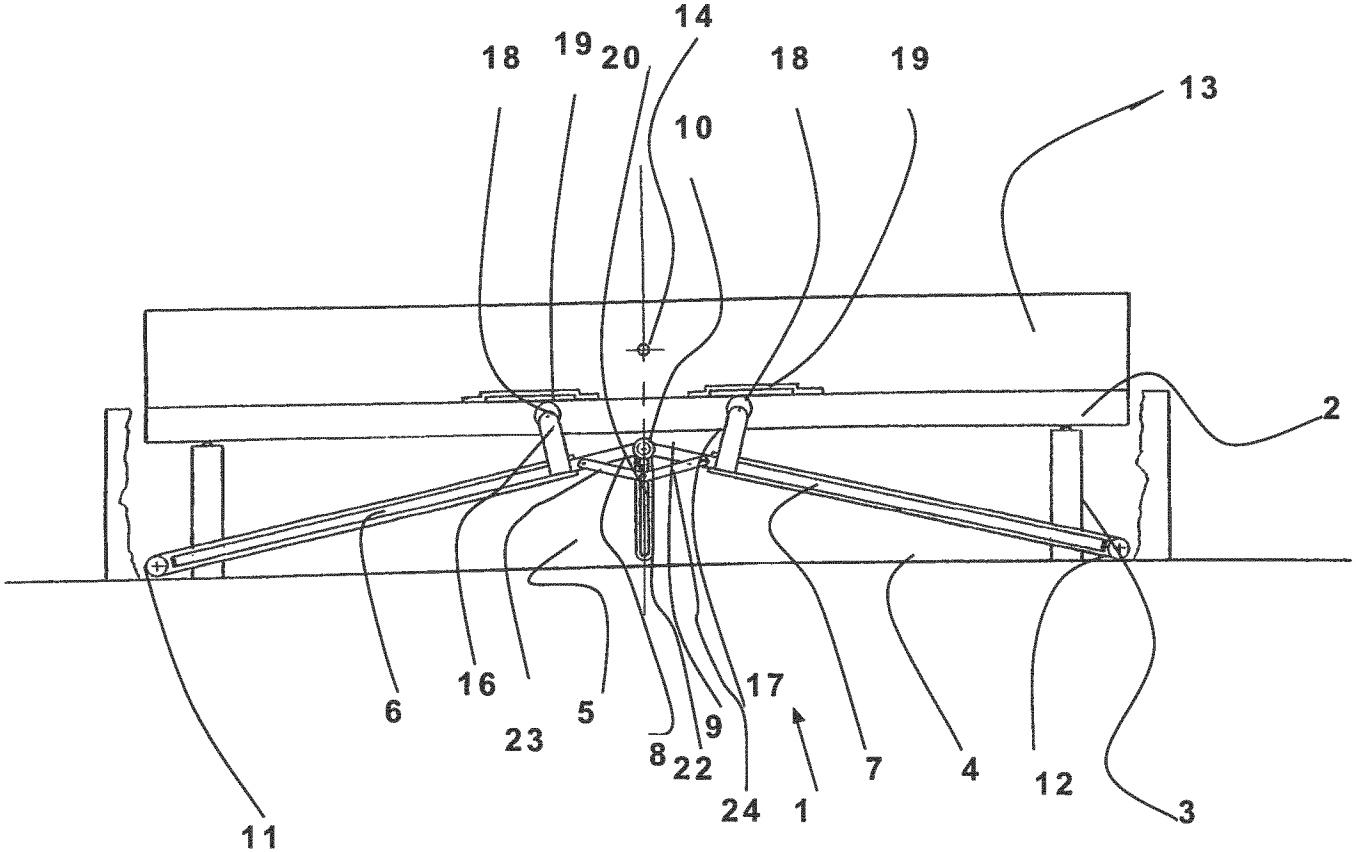
Figure 2:
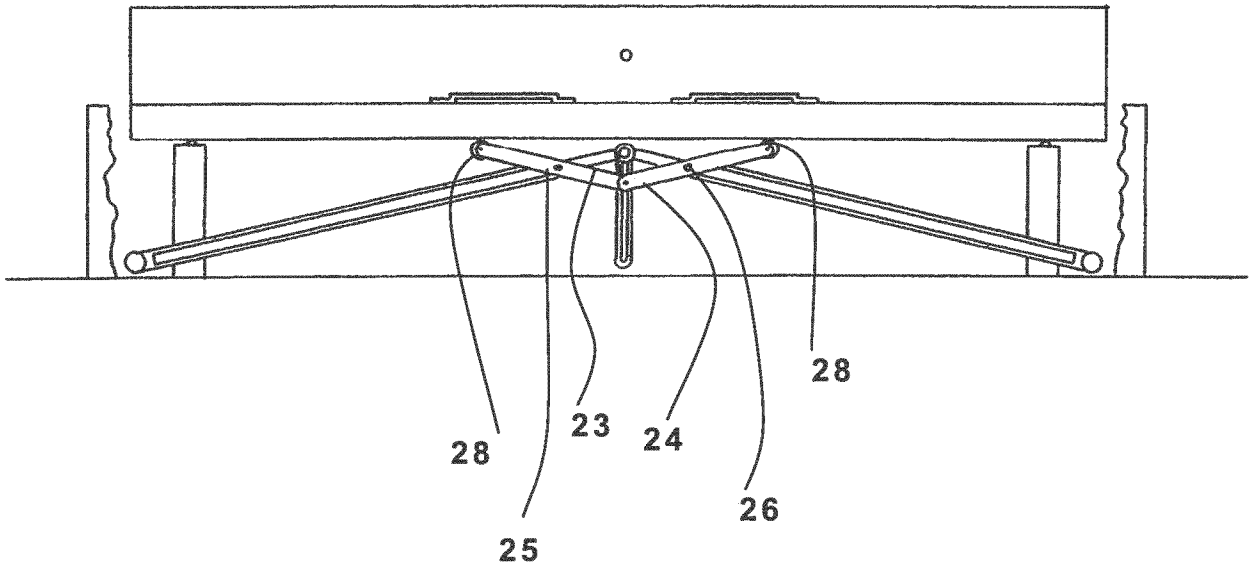
Figure 3:
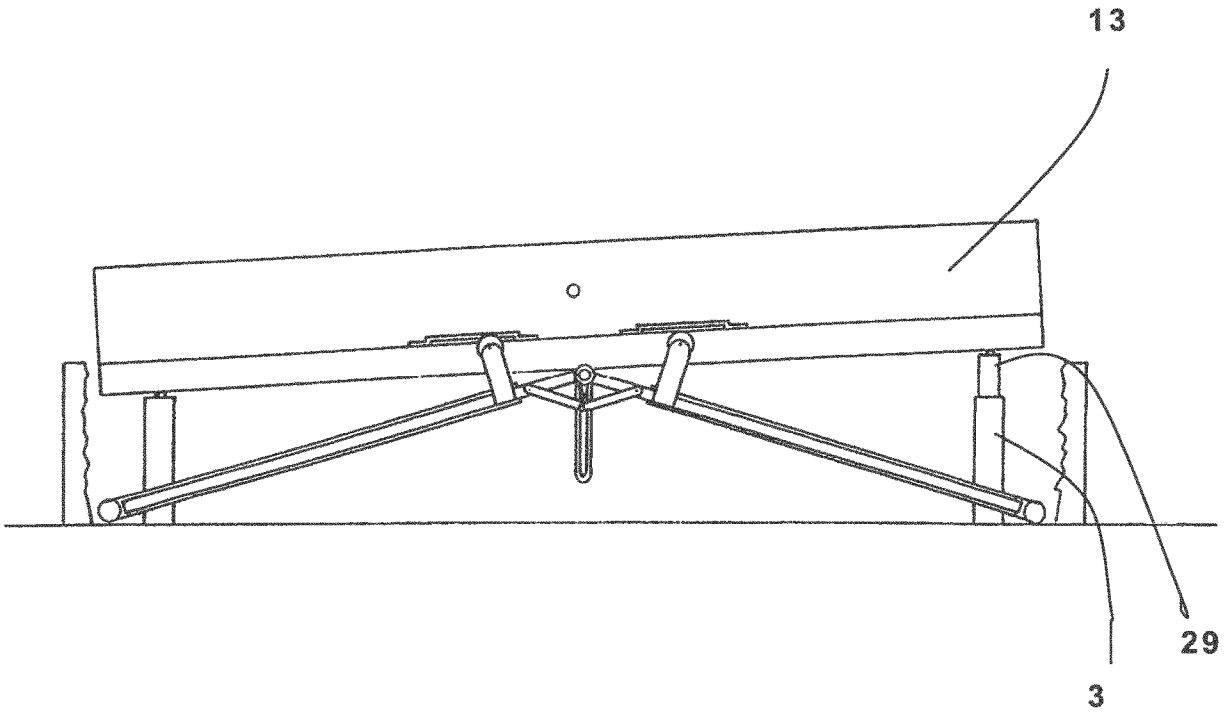
Figure 4:
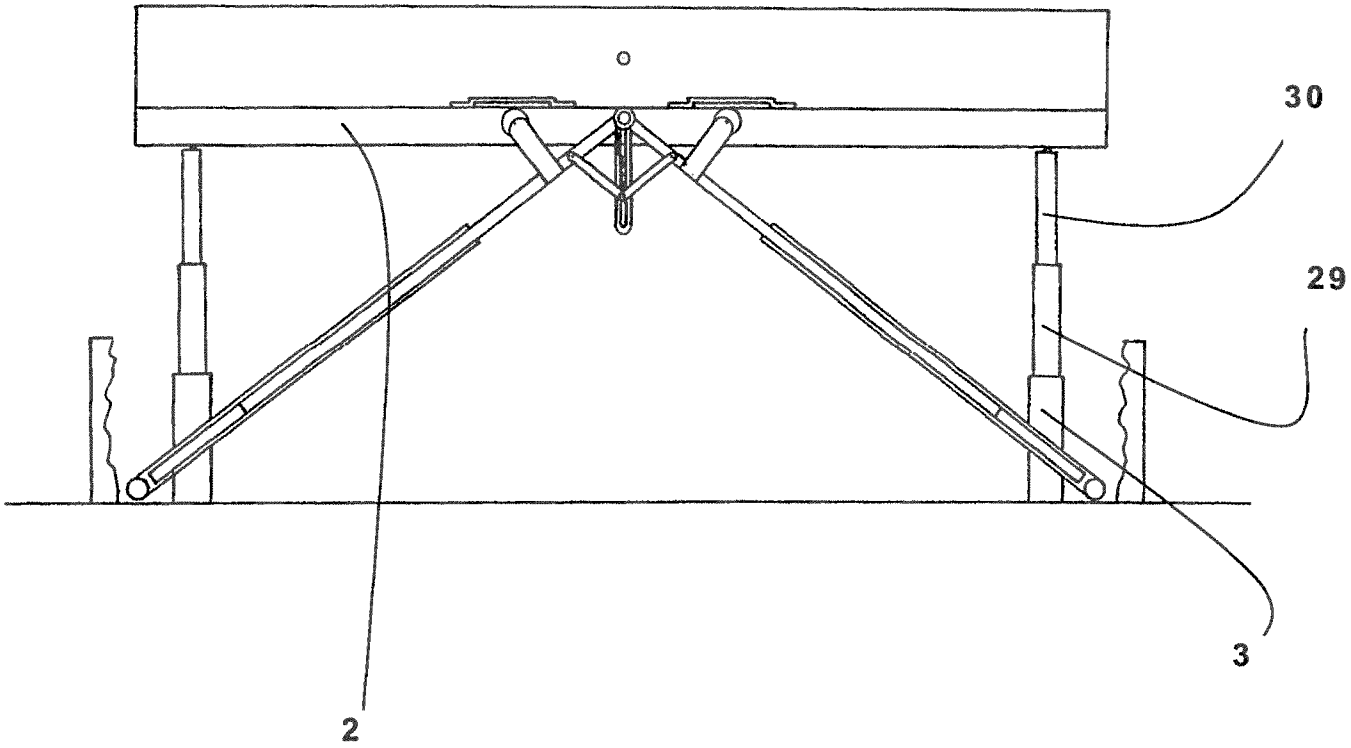
Figure 5:
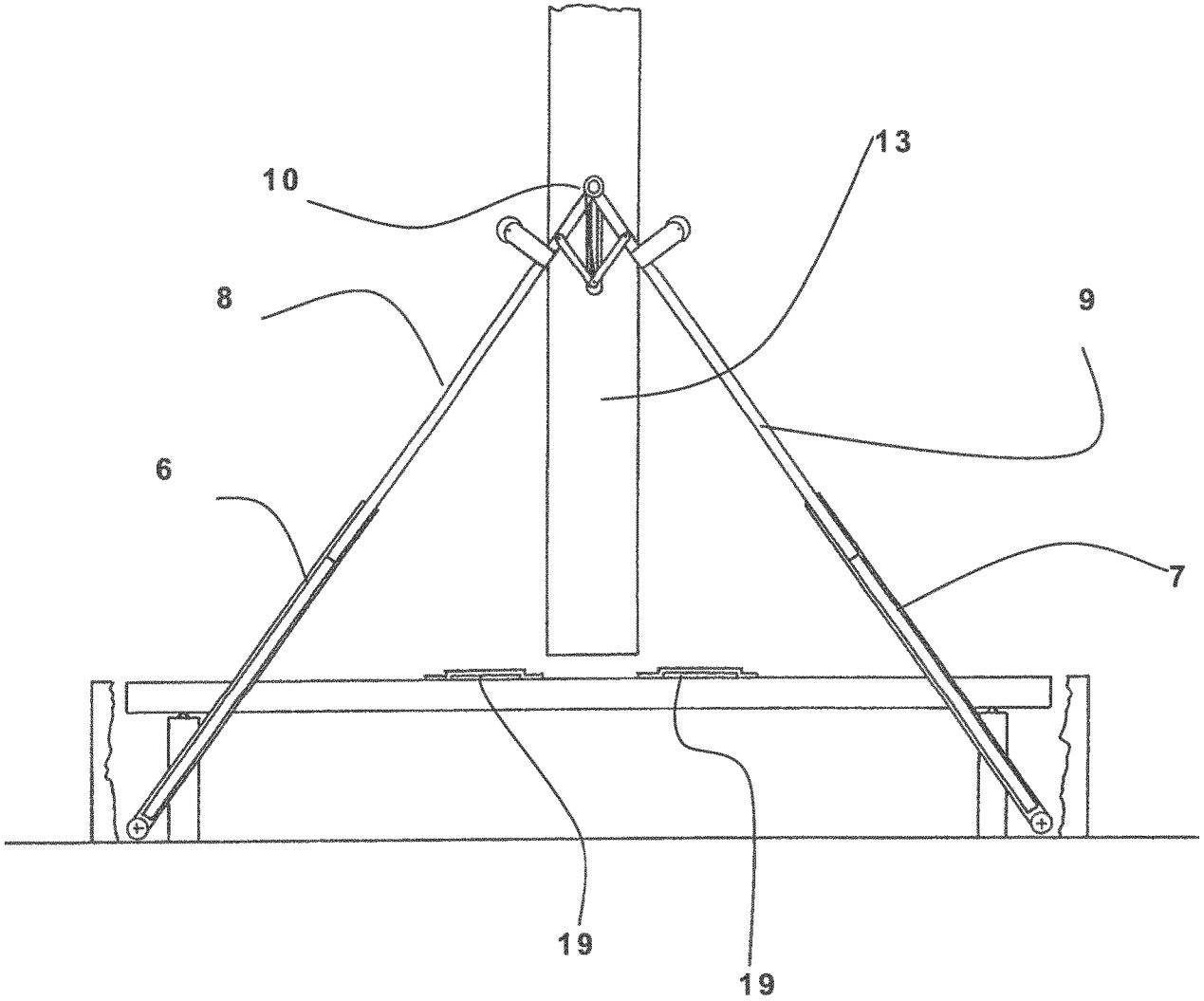
Figure 6:
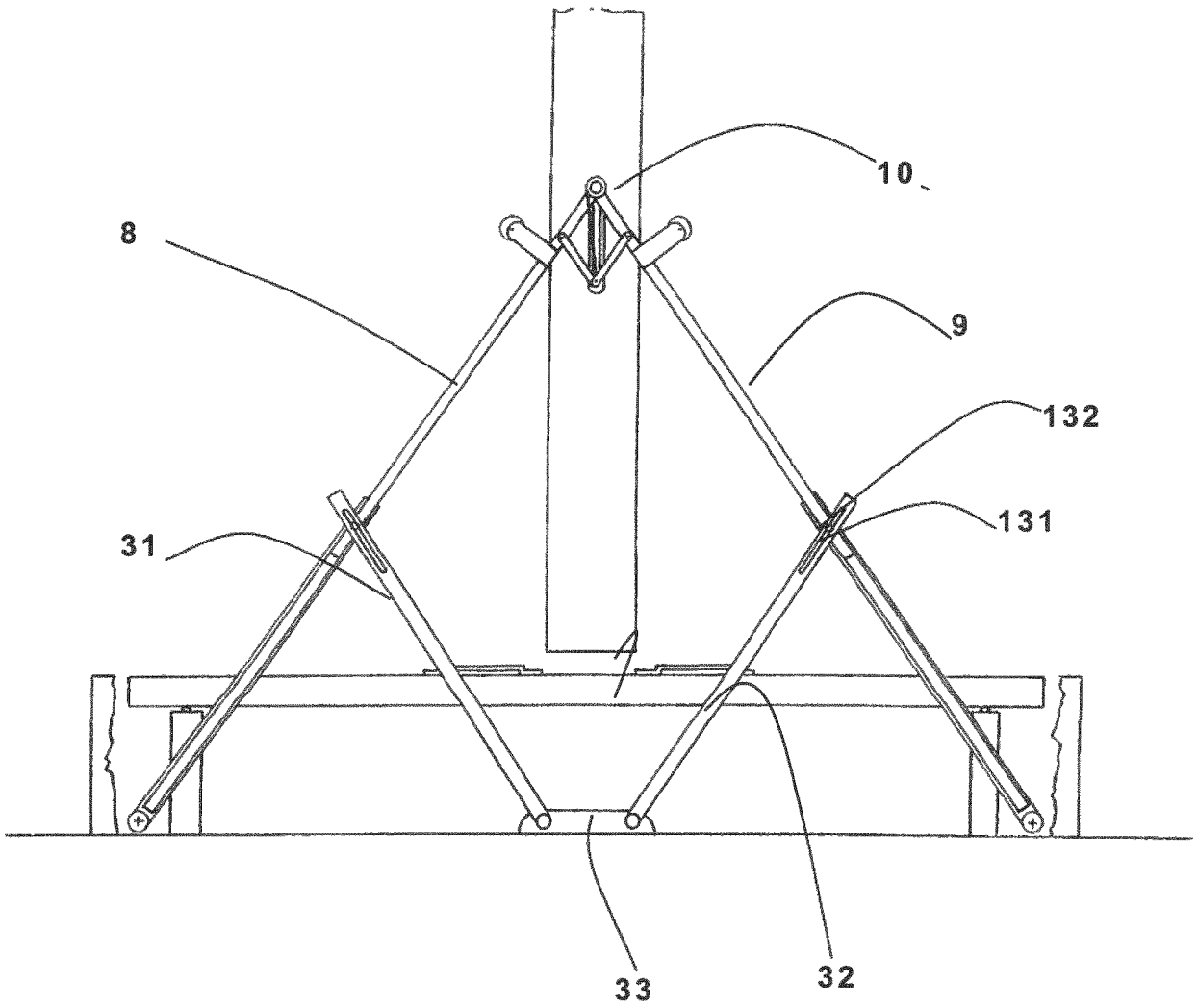
Figure 7:
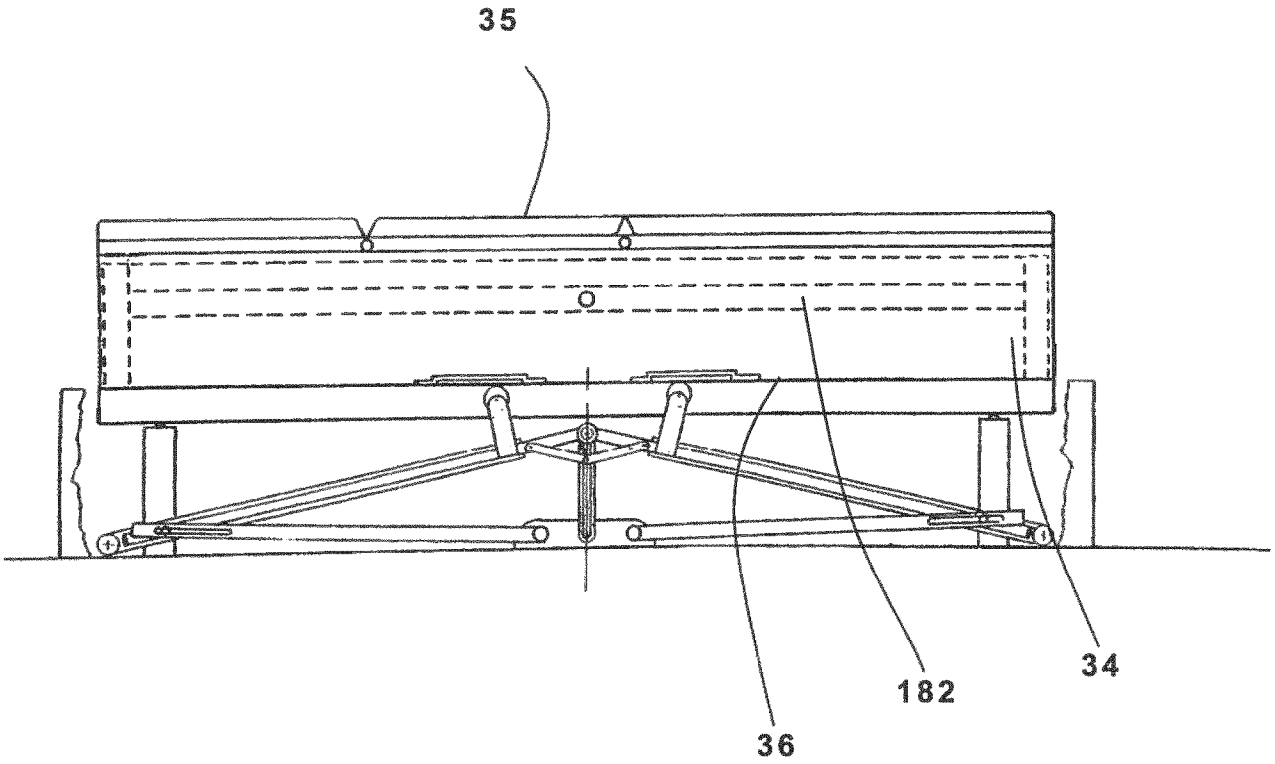
Figure 8:
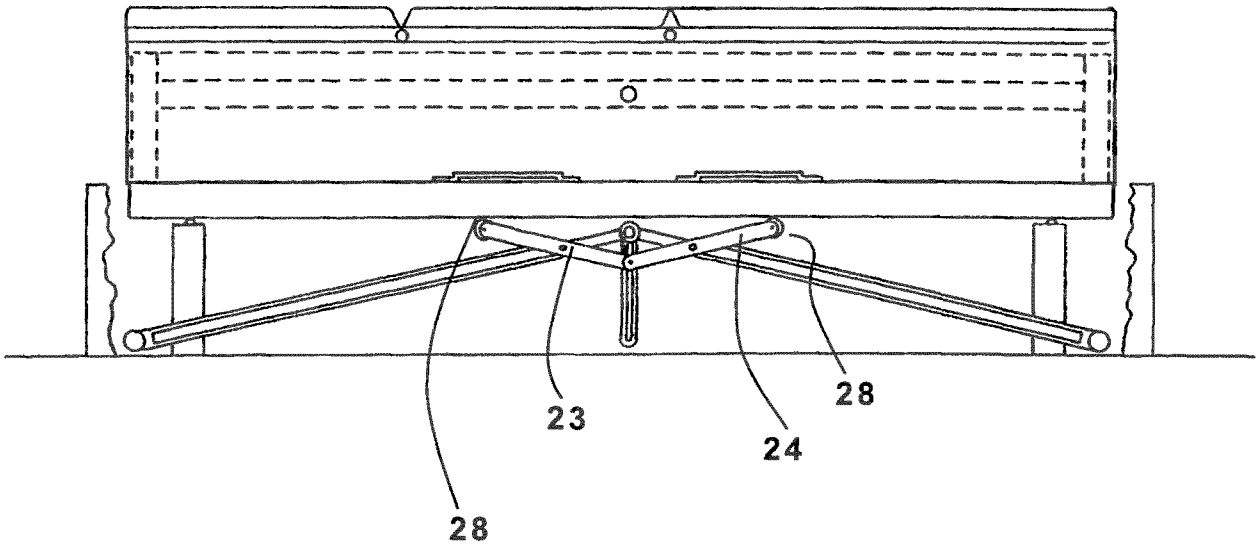
Figure 9:
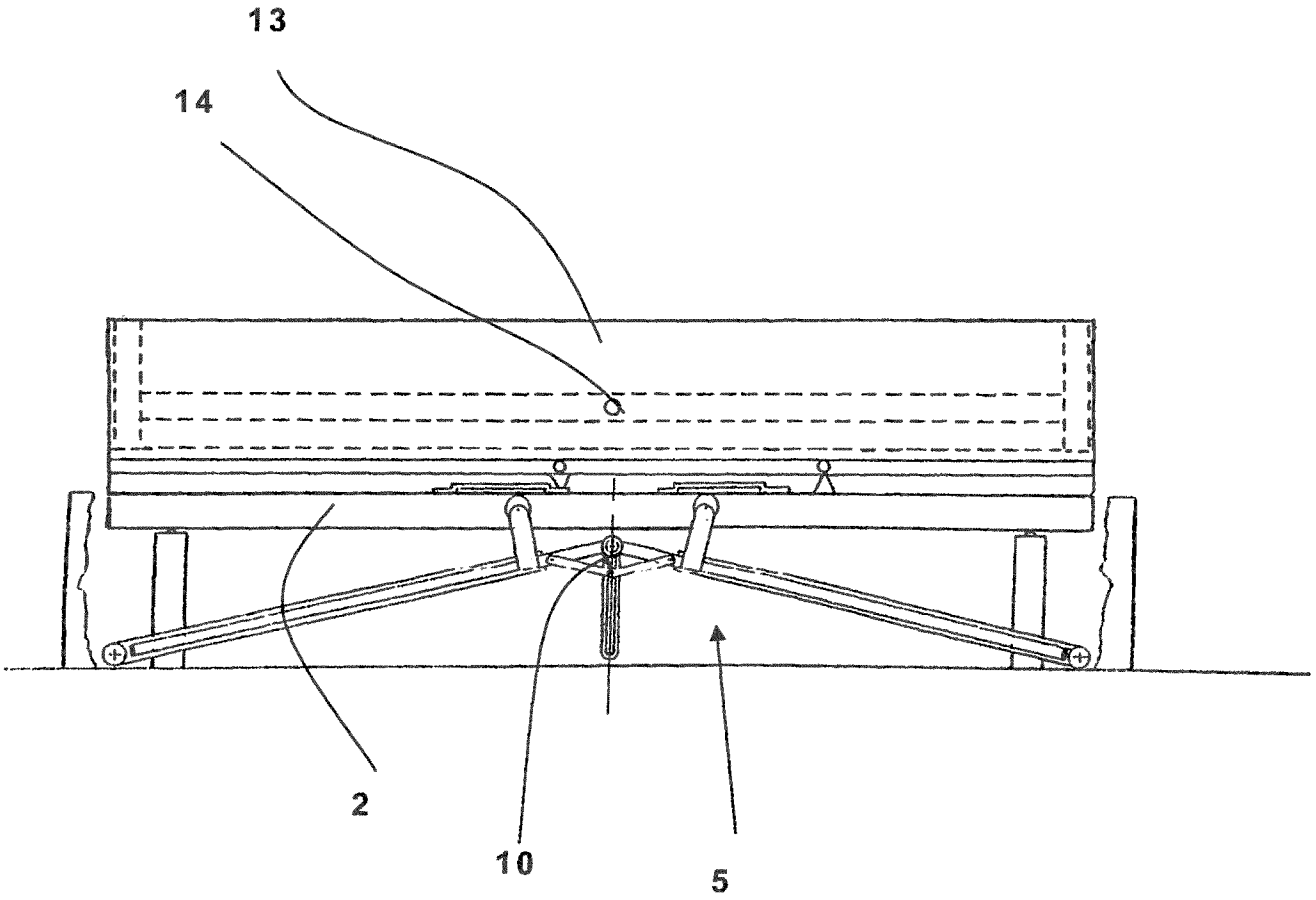
Figure 10:
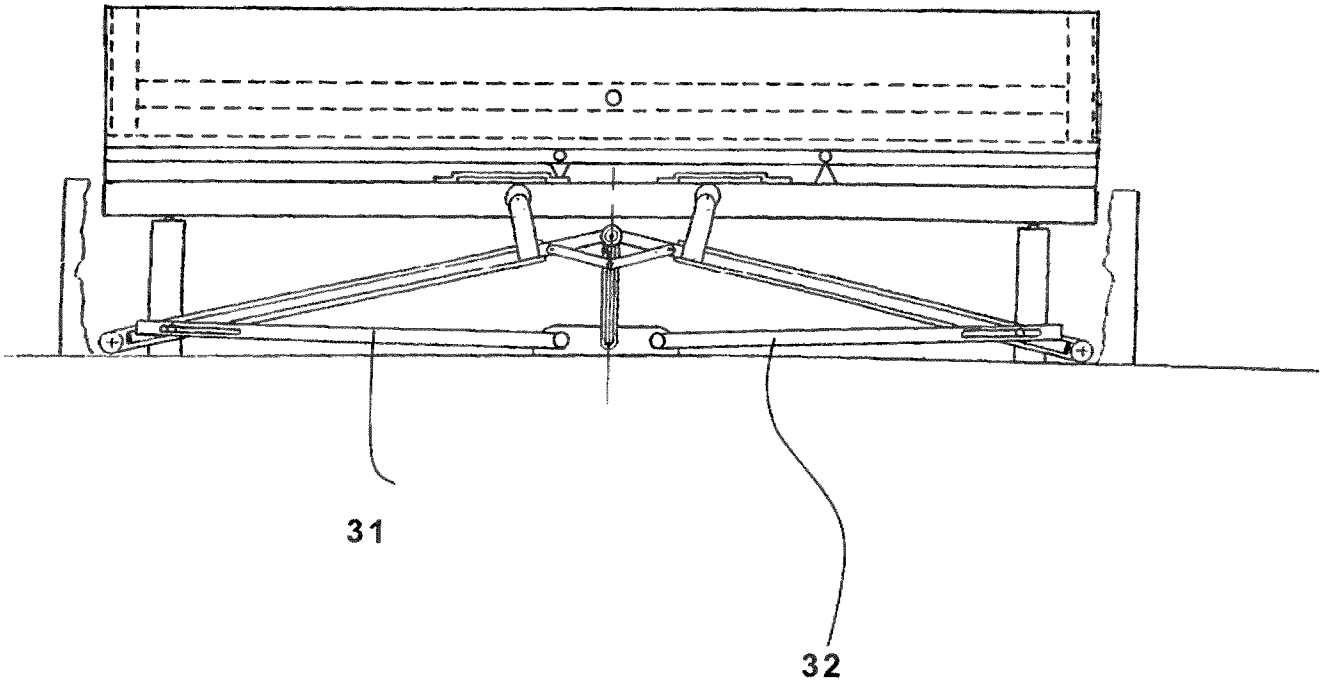
Figure 11:
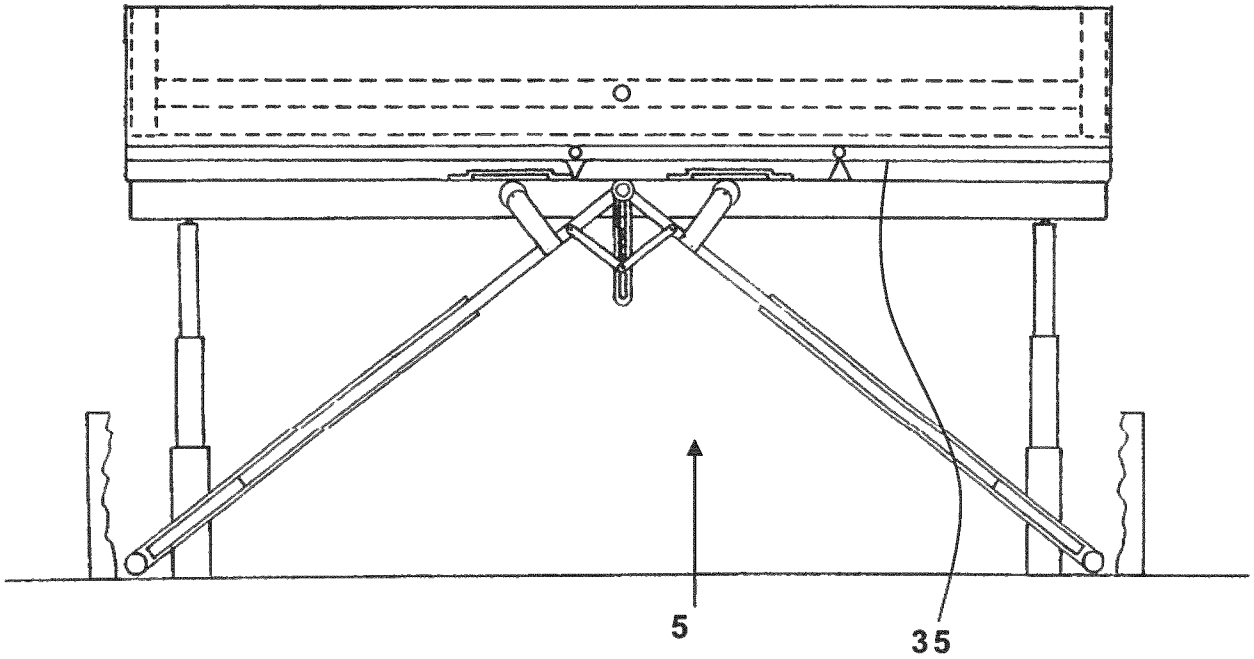
Figure 12:
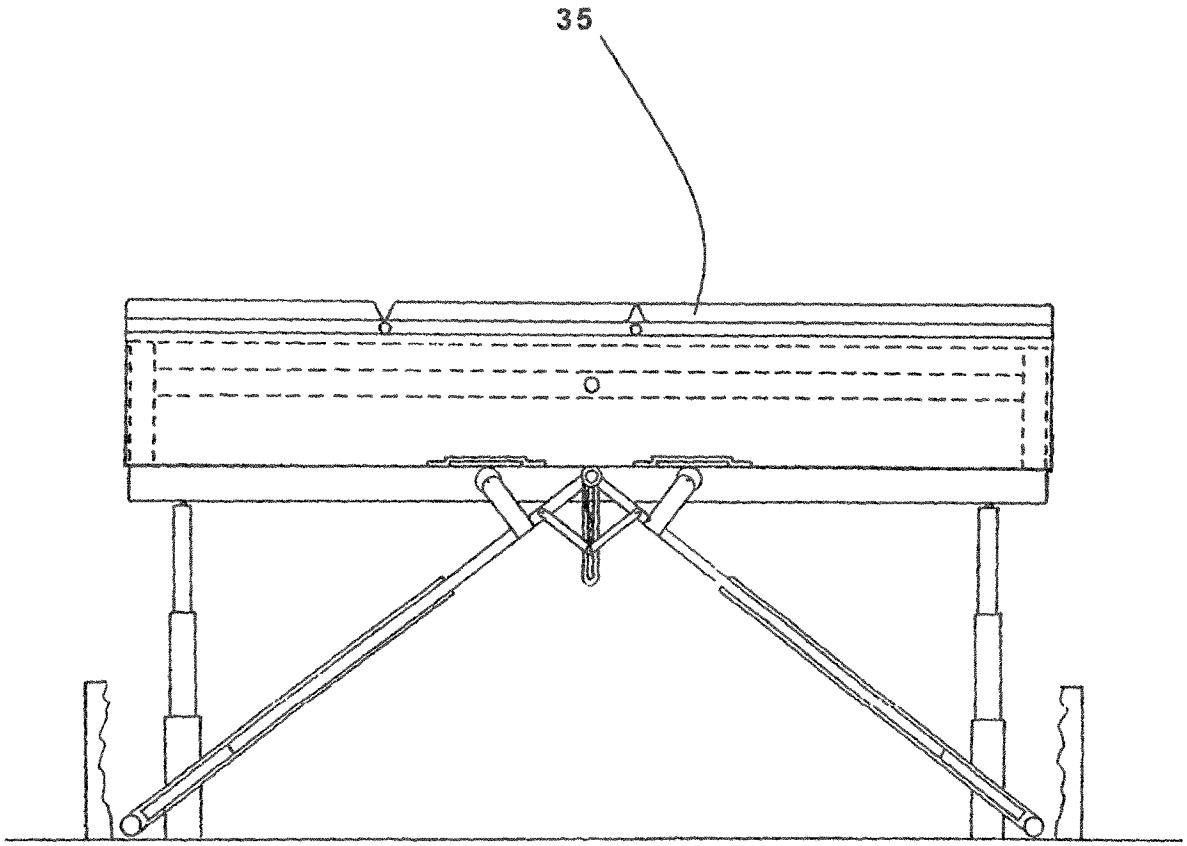
Figure 13:
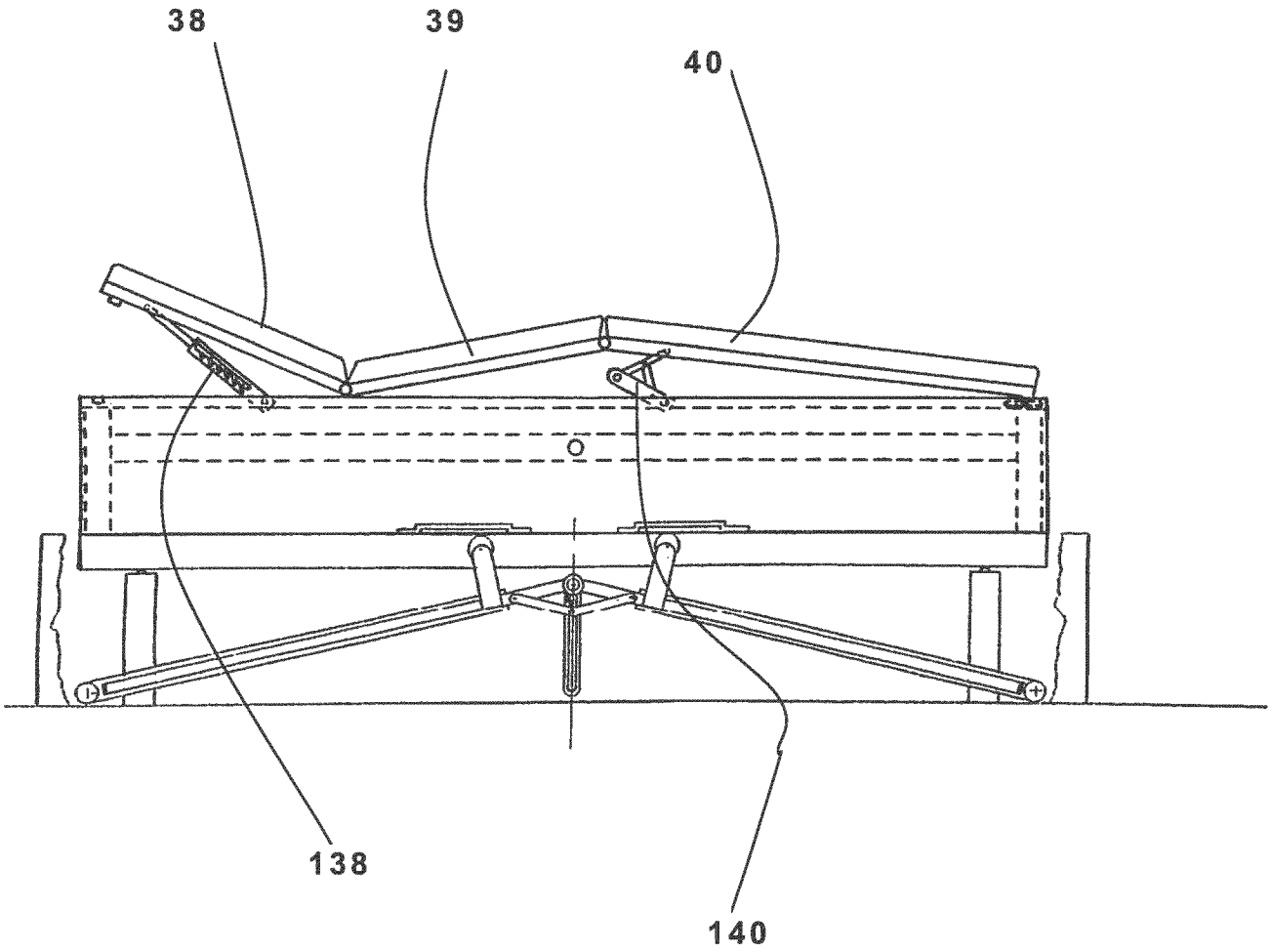
Figure 14:
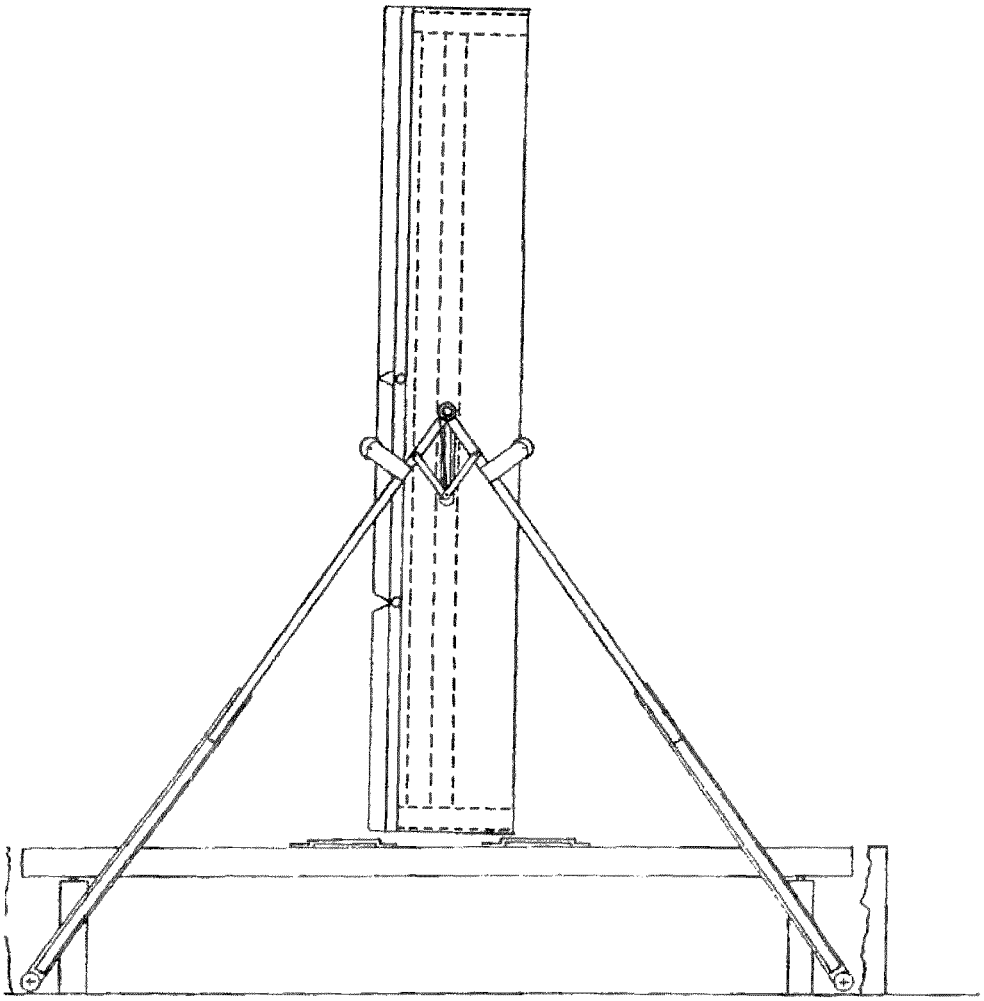
Figure 15:
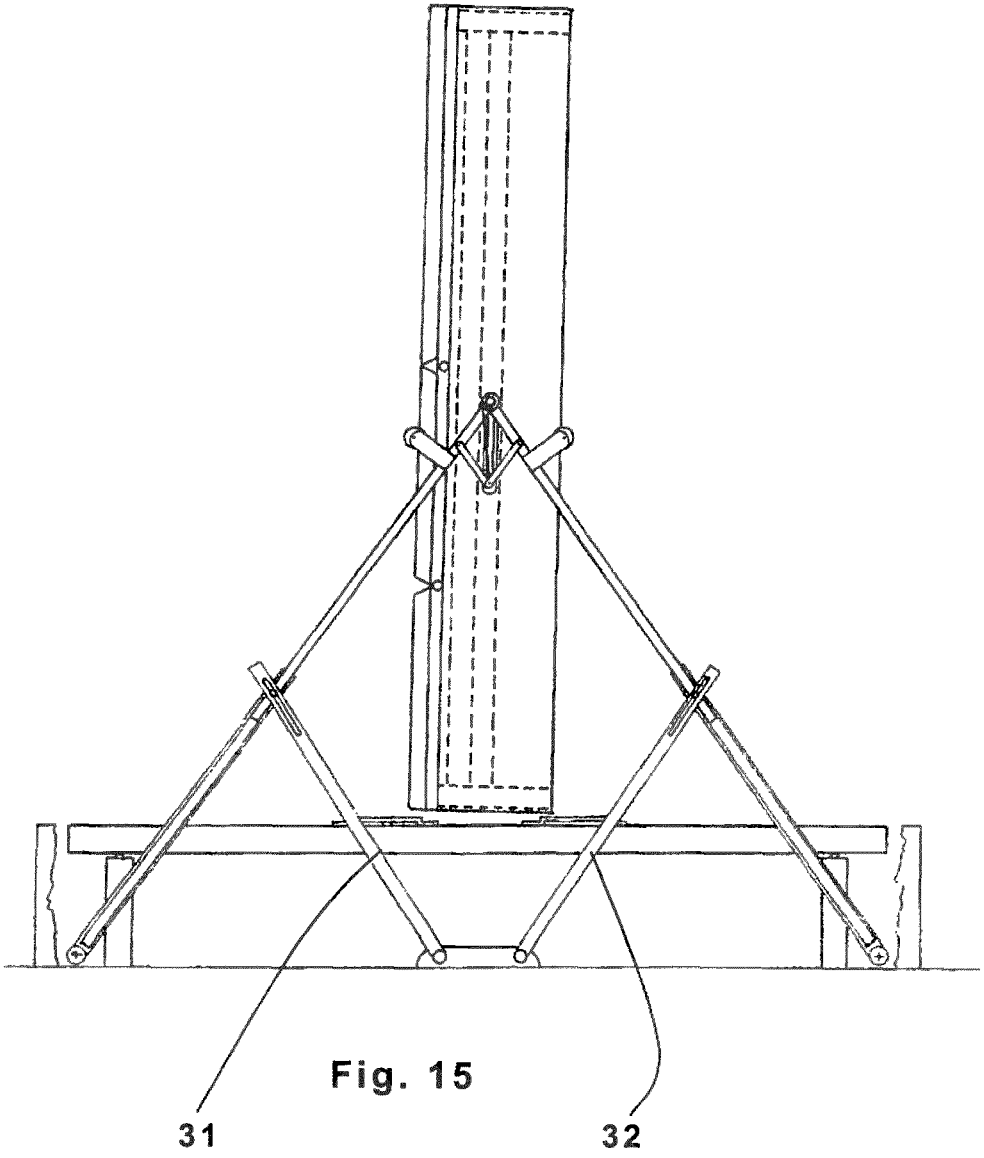
Figure 16:
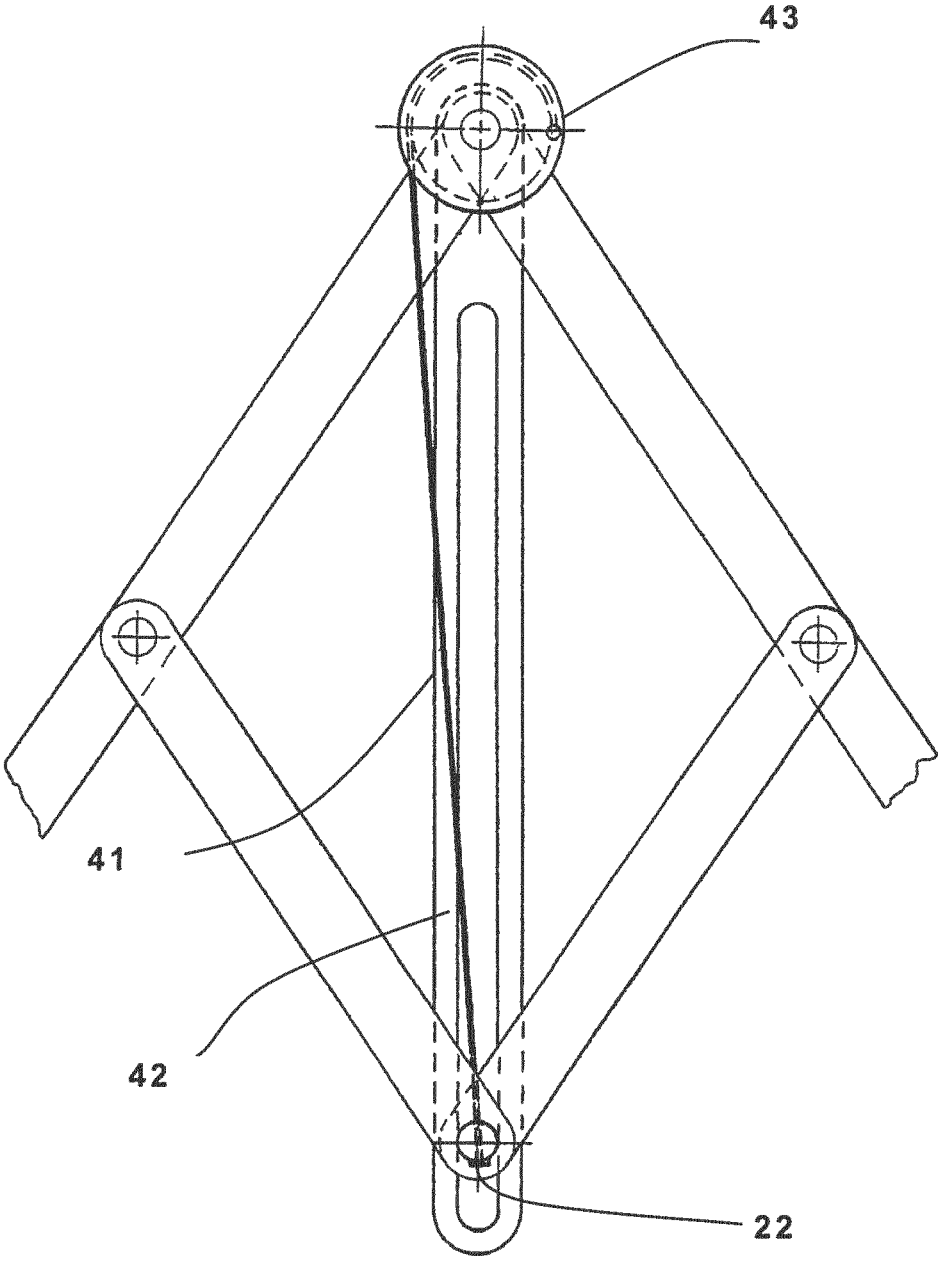
Figures 17, 18:
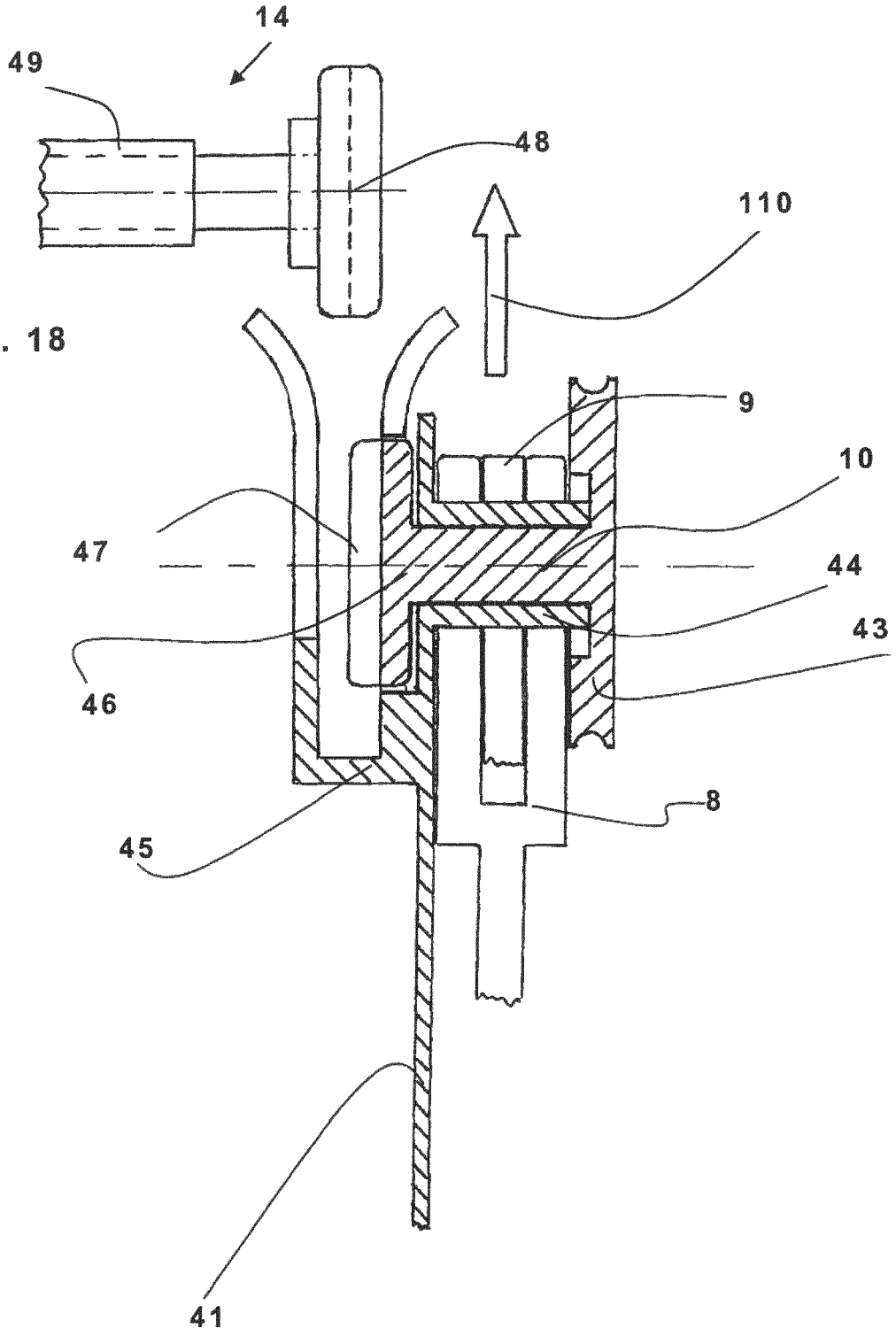
Figure 19:
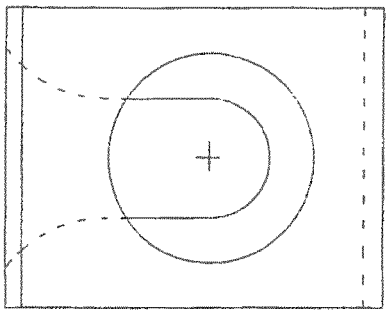
Figure 20:
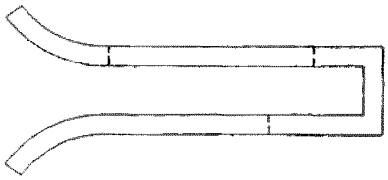
Figure 21:
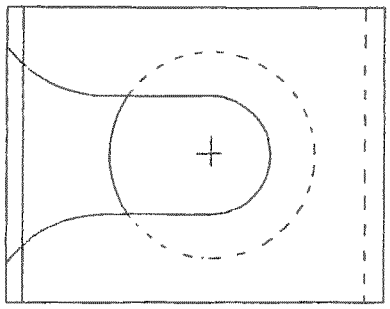
Figure 22:
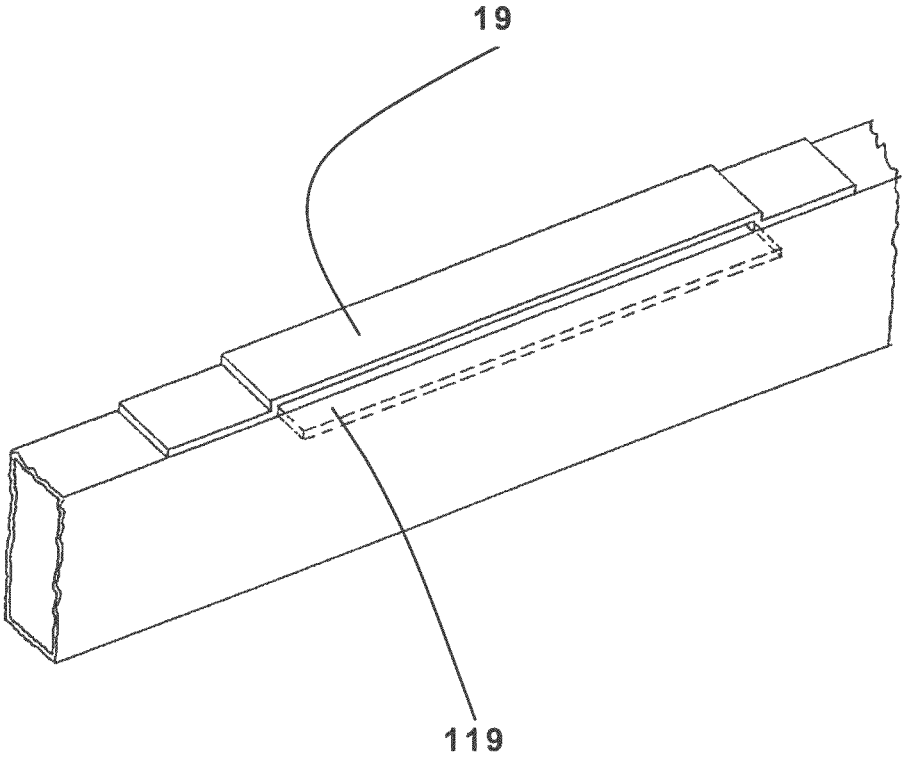
Figure 23:
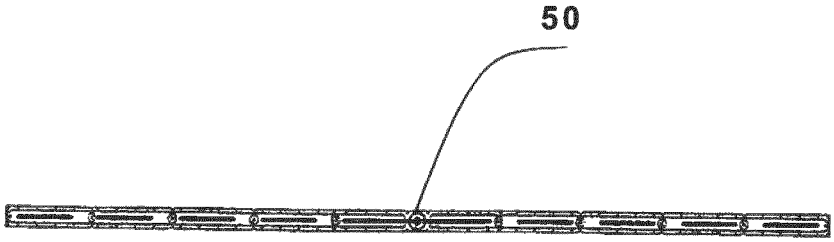
Figure 24:
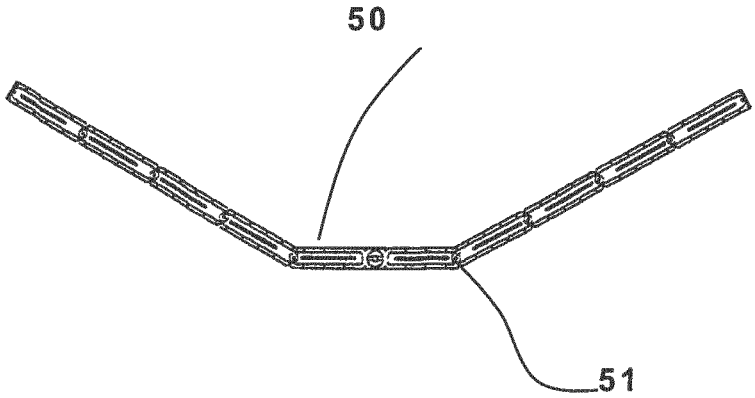
Figure 25:
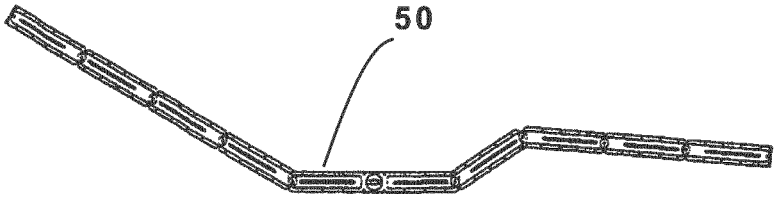
Figure 26:
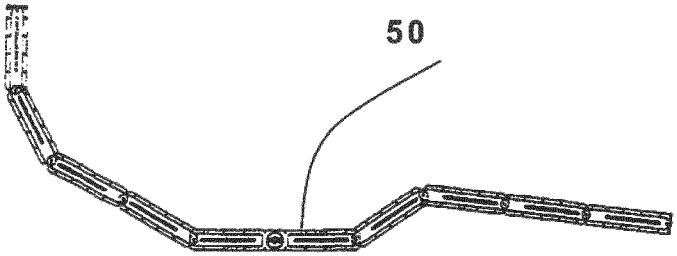
Figure 29:
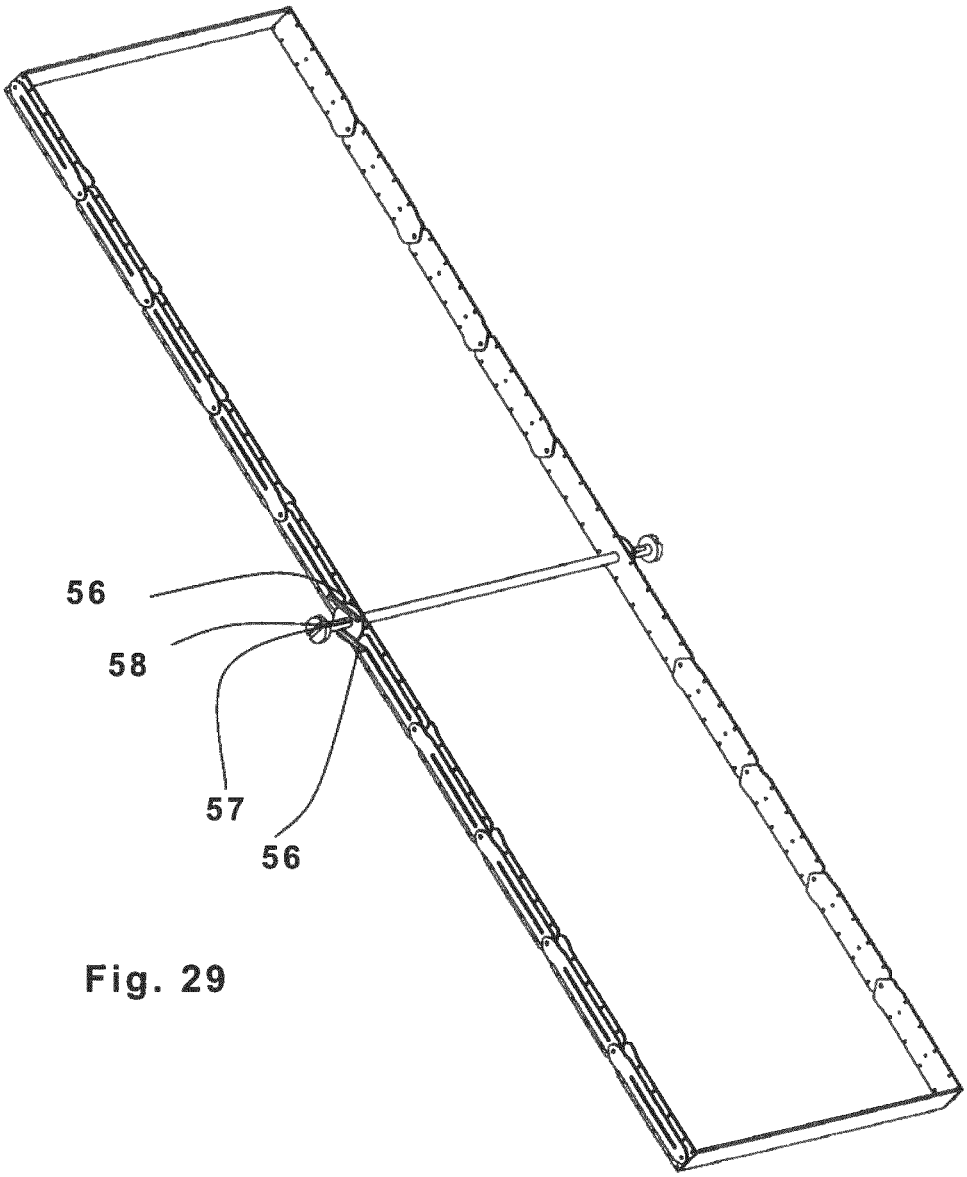
Figure 30:
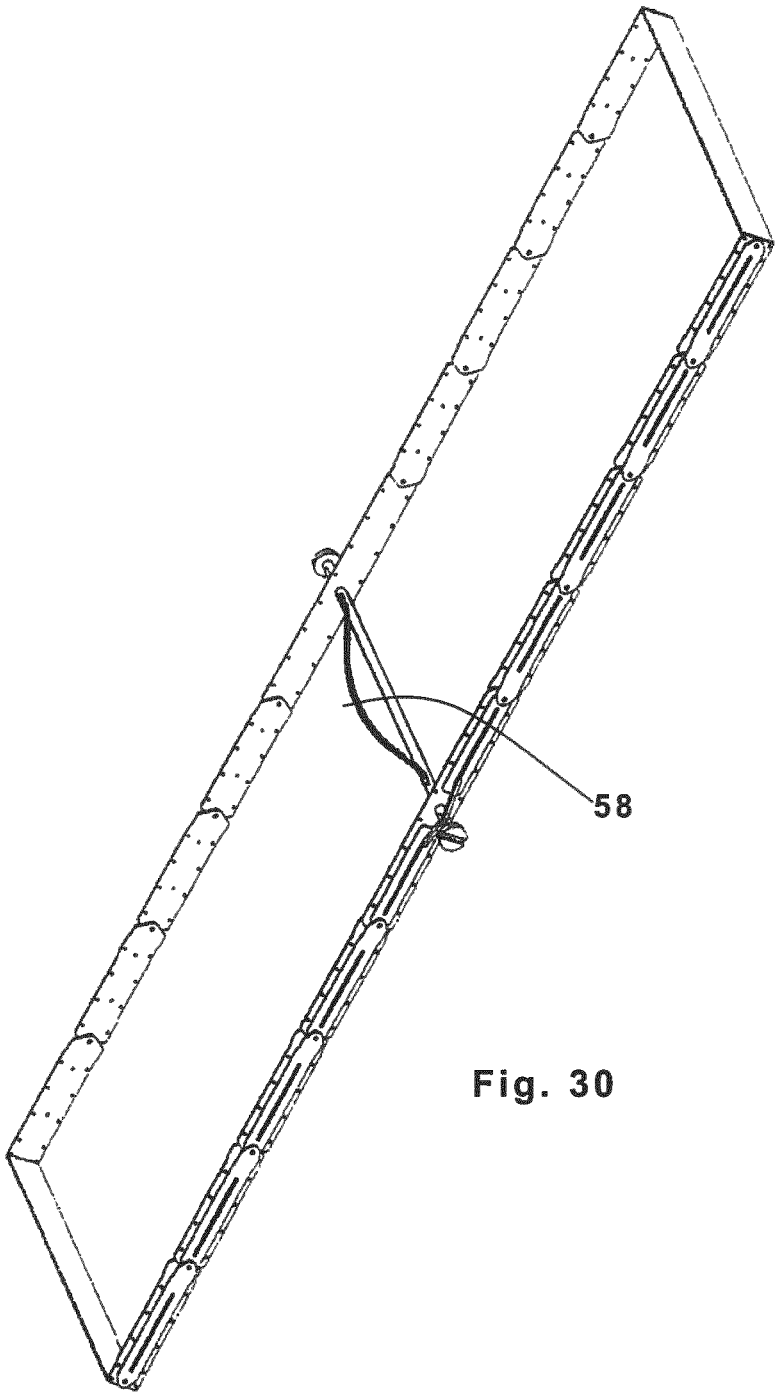
Figure 31:
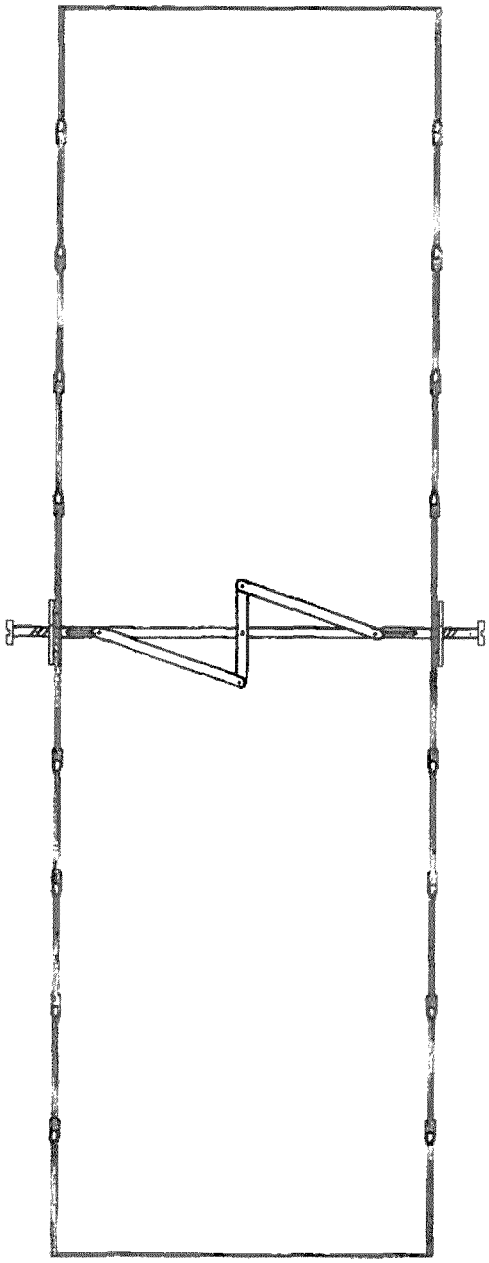
FIGS. 31 and 32 show the possibility of transmitting the movement from a chain/frame to the one parallel thereto through two levers sliding in respectively a slot at one end and articulated respectively to another lever at their other ends.
Figure 32:
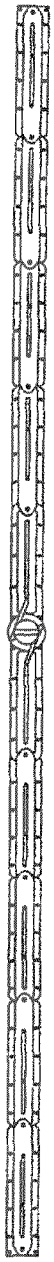
Figure 33:
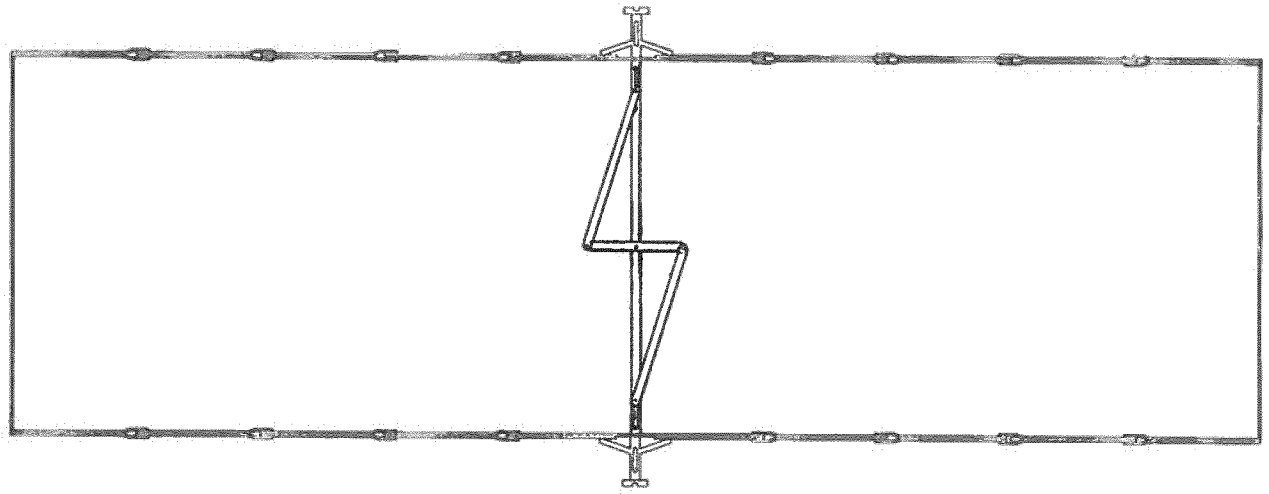
Figure 34:
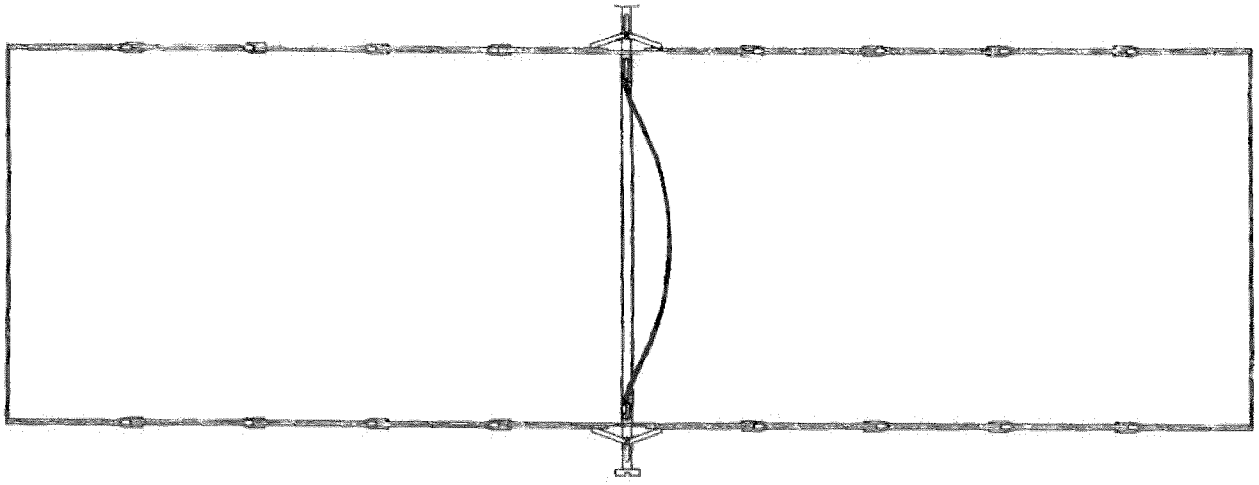
Figure 35:
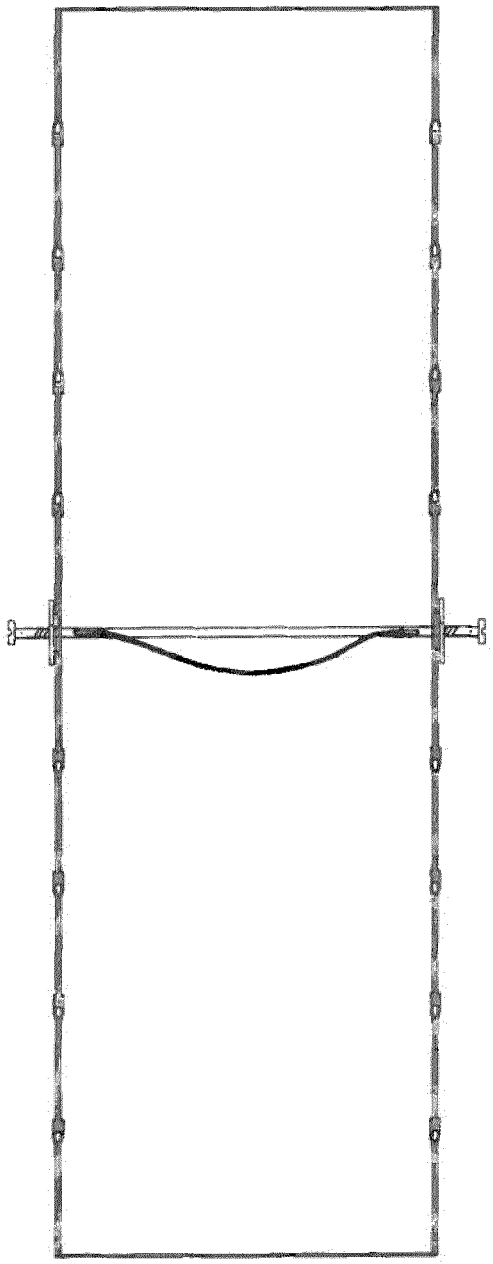
FIGS. 35 and 36 show the movement positions of the plaques obtained through a Bowden cable.
Figure 36:
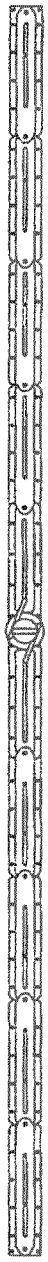

The beam 89 also carries, in its halfway plane, a pulley 93 of the type as shown in FIGS. 16 to 18. A wire or rope 94 is wound around the pulley 93 fixed at its free end to a connection 96 integral to the support plate/sub-frame 73.

Appropriately the pulley 93 is elastically loaded by a spring 94 with respect to the beam 59. The cooperation between the pulley 93 and the pin 72 and making the mattress 71 turn.

Figure 41:
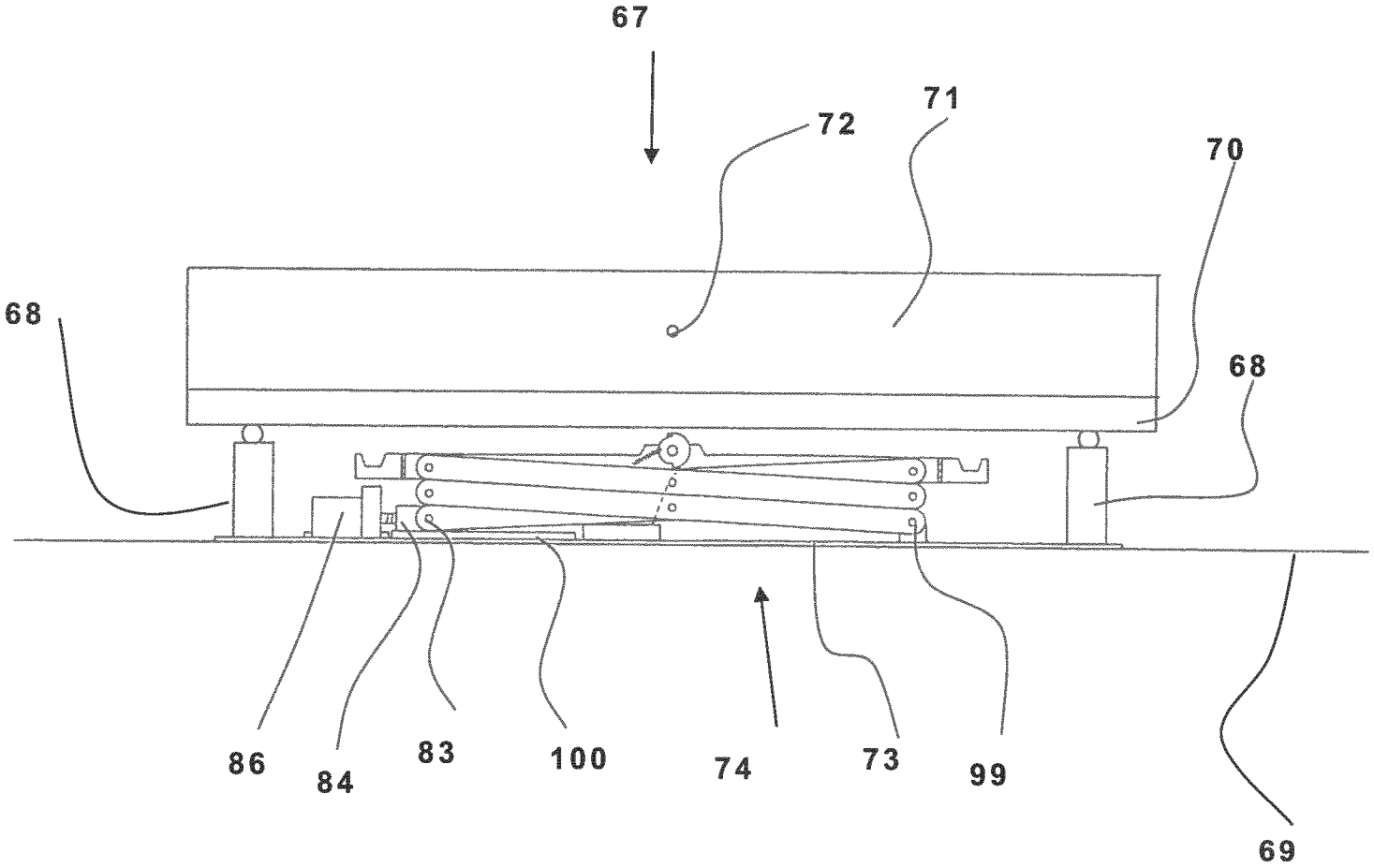

In a known way the pulley 93 is equipped with a free-wheel or unidirectional castor adapted to keep the key 47 in FIG. 17 in the engagement position with the hollow of disc 48 of the pin 14 in FIG. 18 and of the pin 72 in FIGS. 41 and 43.

Finally, it is specified that the term "mattress" does not only refer to mattresses in the strict sense, but also to beds, sofa beds or to any object that is to be crossed from one side to the other side in order to make a person lie down or to treat them either for resting, sitting or massages.

KEY

1. bed
2. frame
3. telescopic feet
4. element
5. movement mechanism
6. guide
7. guide
8. stall
9. stall
10. articulation pin
11. articulation
12. articulation
13. mattress
14. pins
16 arm
17 arm
16 rollers
18 pockets
23 stall
24 stall
25 joint
26 joint
29 telescopic section
30 telescopic section
31 lever
32 lever,
33 base
34 mattress
35 mattress plane
36 sleeping side
38 head element
39 lumbar element
40 lower element
41 slot
42 slot
43 pulley
44 bushing
45 guide funnel
46 disc
47 key
48 disc
50 chain/frame
51 articulations
52 pintles
53 slots
54 plaques
55 joints
56 connecting rods
57 filter
58 screw
59 rope
60 pin
61 mattress
62 case
63 drums
64 pulley
65 stop
66 motorised rotation mechanism
67 frame-base-mattress
68 feet
69 floor
70 frame
71 mattress
72 rotation pin
73 support plate
74 pantograph
75 staff
76 staff
77 joint
78 staff
79 staff
80 joint
81 joint
82 joint
83 joint
84 slider
85 screw
86 motor
87 joint
88 joint
89 beam
90 slot
91 tab
92 tab
93 pulley
94 spring
95 wire
96 connection
97 section
98 section
99 joint
100 guide
110 arrow
119 plates
131 slot
132 pintle
138 actuator
140 actuator
182 mattress frame

The invention claimed is:

1. A method for moving mattresses, beds or armchairs into an operating position comprising the following steps:

equipping a bed with a frame, a base, a mattress having gripping pins projecting from the mattress along their halfway plane, with a movement mechanism;

raising the movement mechanism up to the mattress gripping pins;

coupling the mattress pin with an articulation pin of the movement mechanism;

raising the mattress to a height adapted to allow the rotation of the mattress about its halfway plane;

rotating the mattress about its pins to bring it into an overturned position;

lowering the mattress until it is resting on the base supported by feet;

raising the frame with interception member that is supported by an activator of the movement mechanism;

keeping the frame in position by the frame-supporting feet;

arranging the mattress side facing upwards;

intercepting the frame with the interception member; and lowering the frame with the mattress with the interception member into a position of use.

2. The method according to claim 1, further comprising the step of:

activating a tilting system for tilting the mattress in one direction or the other.

3. The method according to claim 1, further comprising the step of: raising the mattress to a suitable height so that in a suitable space between the base and the mattress ultraviolet rays are irradiated by at least one neon lamp for eliminating dust mites.

4. The method according to claim 1, further comprising the step of: lowering the mattress to a suitable distance between said mattress and the base for irradiating onto the direct side facing downwards at least a neon or LED lamp for eliminating dust mites.

5. The method according to claim 1, further comprising the step of: releasing the activator from the frame.

6. A mechanism for moving mattresses, beds or armchairs into an operating position comprising a bed having a frame, supported by telescopic feet positionable at various heights with respect to a floor, a lifting mechanism being comprised of extensible guides comprising staffs which are respectively slidable into said guides, said staffs having ends that converge to an articulation pin, and having opposite ends that are equipped with articulations, wherein on the frame a mattress is disposed having pivot pins project outwardly from a halfway plane of said mattress which can be coupled with articulation pins of the staffs wherein, a parallelogram has articulations which are connected to one another by a guide slot with an articulation capable of sliding in the guide slot, the staffs being articulated to the articulation pin, with the interposition of a bushing between the staffs and the articulation pin, the articulation pin extending on one side into a pulley with a return spring around which a wire is wound, fixed at its free end with the articulation, the wire at a certain height of the mattress being taut and further reducing an angle, the wire making the pulley rotate so as to turn the mattress itself.

7. The mechanism according to claim 6, wherein the articulation pin extends into a first disc with a key adapted to be coupled with a groove of a second disc at an end of the pivot pin, the pivot pin being adapted to be pulled out from a tubular portion fixed to the mattress frame.

8. The mechanism according to claim 7, wherein the second disc in the advancement of the articulation pin is appropriately oriented by a guide funnel extending above the guide slot.

9. The mechanism according to claim 6, wherein rods are articulated at equal distances from the articulation pin to the staffs hence forming the parallelogram with the staffs.

10. The mechanism according to claim 6, wherein arms are substantially fixed at an end of the guides to the staffs, the arms carrying rollers or wheels or cylinders adapted to come into contact with plates exiting from pockets provided on the top or bottom side of the frame.

11. The mechanism according to claim 6, wherein rods extend beyond their joints to carry at their ends rails or cylinders in contact with plates exiting from pockets provided on the top side of the frame.

12. The mechanism according to claim 6, wherein the articulation pin is moved by levers articulated to a base and engaged through a slot with a pintle projecting from staffs, respectively.

13. The mechanism according to claim 6, wherein the mattress is a mattress with a board for massages.

14. The mechanism according to claim 13, wherein the board for massages is comprised of a head element, a lumbar element and a lower element connected to one another and activatable by a second lifting mechanism.

15. The mechanism according to claim 6, wherein a mattress frame is formed by two longitudinal chains parallel to one another connected at their ends with fixed elements with the possibility to rotate the links of the chain about articulations, each chain link having pintles that are engaged in slots of plaques connected to one another through joints, the plaques being movable with respect to the links of the chain and their joints being able to be brought to coincide with the articulations of the links of the chain, moving the plaques, the articulations and the joints when the plaques no longer coincide, making the chain rigid.

16. The mechanism according to claim 15, wherein the plaques are moved through connecting rods articulated eccentrically to a ring nut and to the plaques hence by turning a disc by a screw the chain may be brought from a rigid position into a movable position.

17. The mechanism according to claim 15, wherein the movement of the plaques may be obtained by a Bowden cable.

18. The mechanism according to claim 15, wherein the movement with the chain in a parallel position takes place by two levers that respectively slide in a slot of a connecting staff at one end, and are articulated to one another lever at their other ends, respectively.

19. The mechanism according to claim 6, wherein the movement mechanism comprises at least one rope hanging from the ceiling of a room for winding around an additional pin of a mattress, the mattress is raised above a case of a bed, the rope coming unwound from drums to be wound around a pulley, fixed to the additional pin of the mattress, for the rotation of the additional pin, the rope being fixed by a stop to the pulley.

20. The mechanism according to claim 6, wherein an actuator is formed by a pantograph.

21. The mechanism according to claim 6, wherein a pantograph has a beam that intercepts by tabs spaced out from one another and reclining and which is brought into a raised position for the preparation of the bed or an inclined position in one or the other direction in a case in which only one of the tabs is reclined extremely in the transversal direction with respect to the beam.

22. The mechanism according to claim 21, wherein the beam carrying a pulley, a spring and a rope or cable cooperates with a rotation pin, by the pantograph the mattress being raised, the rope or cable fixed at its free end to a connection turning the mattress under tension through 180°.

23. The mechanism according to claim 6, wherein a rope is fixed in any one stationary location relative to the pulley.

24. The mechanism according to claim 6, wherein two or more mechanisms of this type are provided for the bed or mattress.

25. The mechanism according to claim 6, wherein a rope is fixed at its free end in any one fixed point on a sub-frame or to a lower base.

* * * * *